US006883578B2

(12) United States Patent
Whitley

(10) Patent No.: US 6,883,578 B2
(45) Date of Patent: Apr. 26, 2005

(54) METHOD OF ASSEMBLY OF AN UPWARD ACTING SECTIONAL DOOR

(75) Inventor: L. Blake Whitley, Arlington, TX (US)

(73) Assignee: Overhead Door Corporation, Farmers Branch, TX (US)

( * ) Notice: Subject to any disclaimer, the term of this patent is extended or adjusted under 35 U.S.C. 154(b) by 0 days.

(21) Appl. No.: 10/624,336

(22) Filed: Jul. 22, 2003

(65) Prior Publication Data

US 2004/0016520 A1 Jan. 29, 2004

Related U.S. Application Data

(62) Division of application No. 10/046,363, filed on Oct. 29, 2001, now Pat. No. 6,626,226, which is a division of application No. 09/570,618, filed on May 15, 2000, now Pat. No. 6,328,091.

(51) Int. Cl.[7] ..... E06B 9/08

(52) U.S. Cl. ..... 160/133; 160/201; 160/229.1; 160/232; 16/97; 16/225

(58) Field of Search ..... 160/133, 201, 160/232, 229.1; 16/97, 225

(56) References Cited

U.S. PATENT DOCUMENTS

| | | | | |
|---|---|---|---|---|
| 2,732,581 A | | 1/1956 | Heck | |
| 3,103,967 A | | 9/1963 | Gaschen | |
| 3,740,916 A | | 6/1973 | Kenaga | |
| 4,893,666 A | | 1/1990 | Hormann | |
| 5,002,114 A | | 3/1991 | Hormann | |
| 5,170,832 A | | 12/1992 | Wagner | |
| 5,522,446 A | | 6/1996 | Mullet et al. | |
| 5,553,651 A | | 9/1996 | Olsen | |
| 5,622,012 A | | 4/1997 | Schijf | |
| 5,626,176 A | | 5/1997 | Lewis, Jr. et al. | |
| 5,669,431 A | | 9/1997 | Druzynski et al. | |
| 5,782,283 A | | 7/1998 | Kendall | |
| 5,913,352 A | | 6/1999 | Scates et al. | |
| 5,915,444 A | | 6/1999 | Sastri et al. | |
| 5,921,307 A | | 7/1999 | Ford et al. | |
| 5,927,369 A | | 7/1999 | Pedersen | |
| 5,934,352 A | | 8/1999 | Morgan | |
| 5,992,497 A | * | 11/1999 | Jaehnen et al. | 160/201 |
| 6,006,817 A | | 12/1999 | Stone et al. | |
| 6,047,761 A | | 4/2000 | Jachnen et al. | |
| 6,098,697 A | | 8/2000 | Krupke et al. | |
| 6,328,091 B1 | | 12/2001 | Whitley | |
| 6,363,993 B1 | * | 4/2002 | Aquilina | 160/229.1 |
| 6,510,589 B2 | * | 1/2003 | Schrage | 16/366 |
| 6,626,226 B2 | | 9/2003 | Whitley | |
| 2003/0192658 A1 | * | 10/2003 | Kendall et al. | 160/229.1 |

FOREIGN PATENT DOCUMENTS

| | | |
|---|---|---|
| CH | 686 281 A5 | 2/1996 |
| DE | 299 07 713 U1 | 9/1999 |
| FR | 2106800 | 5/1972 |
| GB | 2 231 668 A | 5/1998 |

* cited by examiner

*Primary Examiner*—Bruce A. Lev
(74) *Attorney, Agent, or Firm*—Garadere Wynne Sewell LLP

(57) ABSTRACT

A method of assembling a sectional upward acting door comprising plural generally planar door panels adapted to be guided between opposed guide tracks. The door panels are provided with hinge assemblies including a hinge plate mounted on the upper edge of one door panel with a pin receiving bore and a cooperating hinge plate with a hinge pin formed thereon mounted on the lower edge of the adjacent panel. One panel may be placed between the guide tracks and suitably supported while the next panel is assembled to the already positioned panel by placing the next panel between the guide tracks and moving it vertically downward to engage the hinge plates on the respective panels. The cooperating hinge plates are configured for snap together engagement which may only be released by intentional manipulation of the hinge plate with the pin receiving bore.

11 Claims, 15 Drawing Sheets

METHOD OF ASSEMBLY OF AN UPWARD ACTING SECTIONAL DOOR

CROSS REFERENCE TO RELATED APPLICATION

This application is a division of application Ser. No. 10/046,363, filed Oct. 29, 2001, now U.S. Pat. No. 6,626, 226 issued Sep. 30, 2003, which is a division of application Ser. No. 09/570,618 filed May 15, 2000, now U.S. Pat. No. 6,328,091 issued Dec. 11, 2001.

FIELD OF THE INVENTION

The present invention pertains to an upward acting multipanel or sectional door with pinch resistant edge profiles between the door panels and wherein the panels are interconnected by hinge assemblies which may be snapped together to facilitate assembly of the door.

BACKGROUND

Multipanel or so-called sectional garage doors and the like have been developed with panel edge profiles between adjacent door panels which are adapted to minimize pinching a person's fingers between the panels when the door moves to a closed position. Although various configurations of door panels with pinch resistant edge profiles are known in the prior art, there has been a continuing need to provide an improved sectional door construction wherein a pinch resistant edge profile is provided between adjacent door panels or sections while satisfying other desiderata in the construction, assembly and operation of multipanel or sectional upward acting garage doors, in particular.

One improvement which has been sought in the development of sectional upward acting doors is the provision of door panels which may be fabricated economically while providing a suitable shape or profile of the upper and lower edges of the panels to minimize the chance of pinching a person's fingers between adjacent panels at the outer or inner side of the door during movement of the panels between door open and closed positions.

Another problem which has not been satisfactorily solved by prior art sectional door designs is the provision of a panel configuration, with or without a pinch resistant edge profile, which also provides for minimizing or eliminating hinge parts which project from the plane of the inner side of the door panel. Accordingly, there has been a need and desire to provide sectional doors wherein the door panels may be stored and shipped to an installation site as substantially flat panels without irregular thickness caused by hinge members or guide member support parts projecting from the plane of the panels.

Still further, there has been a need to provide sectional door assemblies wherein the door panels may be easily connected to each other during assembly of the door at its installation site. In this regard, it has also been deemed desirable to provide for hinge assemblies for interconnecting adjacent door panels wherein the hinge leaves may be easily connected to each other and wherein the hinge leaves may be preassembled to the respective panels, if desired, prior to shipment of the door to the installation site. Furthermore, it has been deemed desirable to provide panel guide member support brackets which permit substantially lateral assembly of the panels between the door guide tracks.

Other desiderata in the art of sectional upward acting doors have been provided by the present invention, as will be appreciated by those skilled in the art upon reading the detailed description which follows in conjunction with the drawing.

SUMMARY OF THE INVENTION

The present invention provides an improved sectional upward acting door which includes door panels having cooperating edge profiles which minimize pinching action therebetween when moving between door open and closed positions.

In accordance with one aspect of the present invention, a sectional upward acting door is provided with door sections or panels which are preferably constructed of rolled or extruded metal or plastic and have cooperating edge profiles wherein the panel edges co-act in such a way as to minimize a pinching action therebetween and which edges have a configuration which facilitates interconnecting the door panels by improved hinge assemblies which, preferably, do not project inwardly beyond the inner plane of the door panel. The configuration of the door panels is also advantageous with respect to the configuration of and fabrication of multiple door types which include uninsulated panels as well as insulated panels of varying insulation thickness.

In accordance with another aspect of the present invention, a sectional upward acting door is provided which includes improved hinge assemblies for interconnecting the adjacent door panels, which hinge assemblies are adapted to cooperate with the door panels to be disposed substantially within a channel or trough space formed between adjacent panels when the door is in a closed position to eliminate projection of the hinge assemblies from the inner side or plane of the door panels.

In accordance with yet another aspect of the present invention hinge assemblies, particularly useful for interconnecting panels of a multipanel or sectional type door, are provided wherein opposed leaves of the hinge assemblies may be "snapped" or pushed together to facilitate ease of assembly of respective door panels to each other. In this way, the door hinge parts or leaves may be assembled to the respective panels prior to shipment to the installation site and the door panels may be interconnected onsite by merely "stacking" the door panels one on top of the other, during which process the hinge parts or leaves automatically interengage with each other to form hinge assemblies between adjacent panels.

Still further, the present invention provides an improved sectional or multipanel garage door and the like which includes hinge assemblies which may be easily snapped or pushed together and also includes improved door guide member support brackets which may also be quickly assembled to a door panel by a snap-in or push-in type motion to assemble the guide member support brackets to structural members of a door panel. In this way the door panels may be assembled substantially laterally with respect to the door guide tracks which receive the aforementioned guide members. Accordingly, an improved door assembly method is also provided which avoids a requirement to preassemble the guide member support brackets to the door panels, thus providing for easier packing and shipping. Moreover, the door panels do not require to be assembled by lifting the panels into positions required by prior art door panels with preassembled guide member support brackets and which must be connected to the guide tracks by inserting the door panels into the horizontal overhead run portion of the guide tracks. Accordingly, the door panels being fitted to a door opening may be assembled by stacking the panels vertically or inserting the panels through the horizontal sections of the guide tracks, if desired. A major advantage of the configuration of the improved sectional door is that the door panels no longer require that the hinge components be fastened to the panels after they have been put in place adjacent each other in the door opening or in the overhead horizontal run portion of the guidetracks.

Those skilled in the art will further appreciate the above-mentioned features and advantages of the present invention together with other important aspects thereof upon reading the detailed description which follows in connection with the drawings.

DETAILED DESCRIPTION OF PREFERRED EMBODIMENTS

Figure 1:
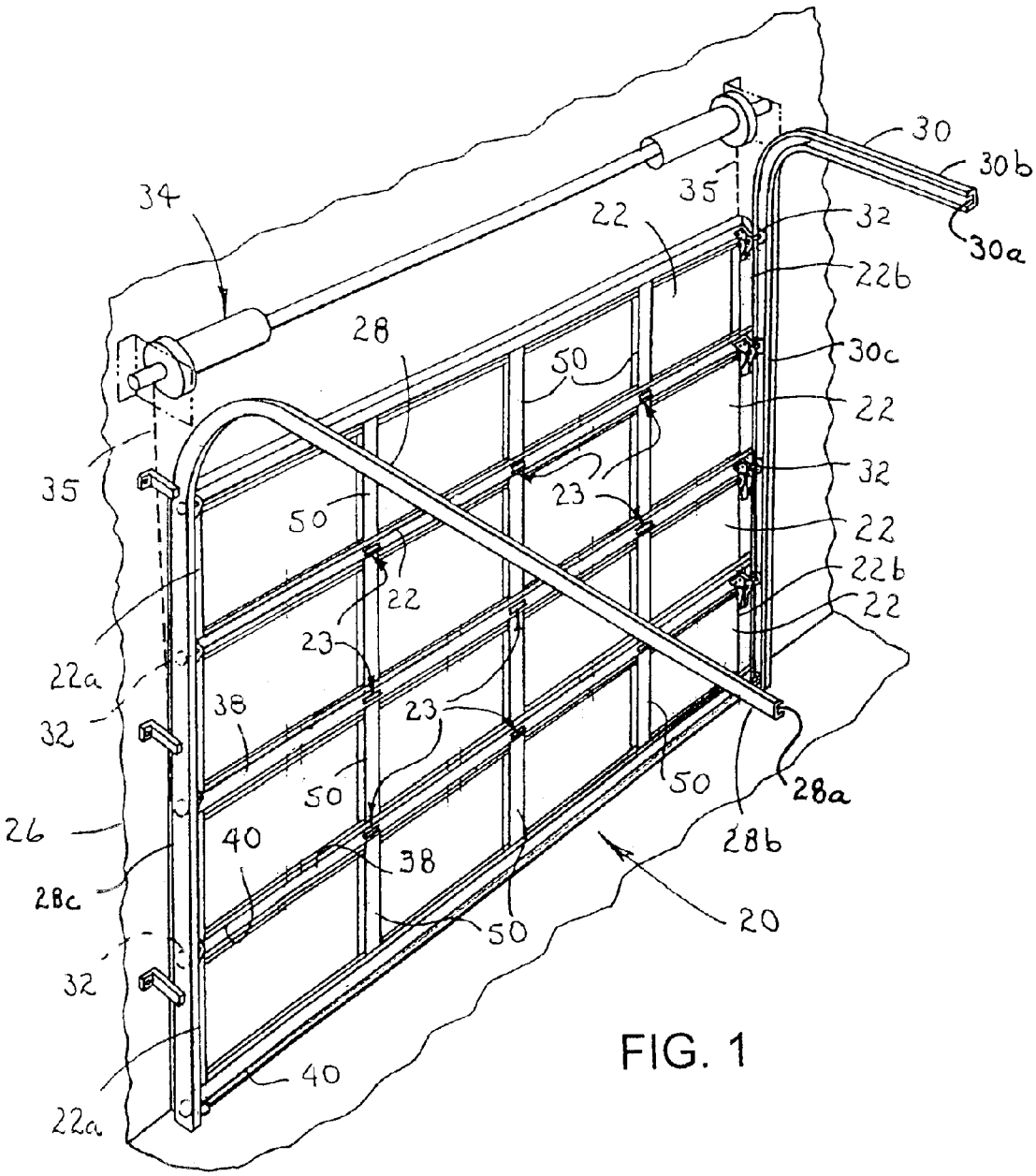
FIG. 1 is a perspective view of an improved sectional upward acting door in accordance with the invention.

In the description which follows, like parts are marked throughout the specification and drawing with the same reference numerals, respectively. The drawing figures may not necessarily be to scale and certain features of the invention may be shown in generalized form in the interest of clarity and conciseness.

Referring to FIG. 1, there is illustrated a sectional upward acting door in accordance with the invention and generally designated by the numeral 20. The door 20 comprises a plurality of interconnected, generally planar door panels 22 which are configured to have edge profiles which cooperate with each other between adjacent door panels to provide for minimizing pinching of a person's fingers, for example, when the door panels are moved relative to each other between open and closed positions of the door. The door panels 22 are interconnected by improved hinge assemblies in accordance with the invention, one embodiment of which is illustrated in FIG. 1 and designated by the numeral 23. The hinge assemblies 23 are spaced apart between opposite side edges 22*a* and 22*b* of the respective door panels 22, as illustrated in FIG. 1. The sectional door 20 is also supported for movement between the closed position shown, which closes an opening in a wall 26, and an open position by spaced apart guide tracks 28 and 30.

Opposed guide members 32 are mounted on the door 20 at spaced apart positions on panels 22 in a manner to be described in further detail herein and are retained in generally channel shaped grooves 28*a* and 30*a* formed in the guide tracks 28 and 30, respectively, in a known manner for supporting the door in its open and closed positions and for guiding the door during movement therebetween. The guide tracks 28 and 30 are configured to include horizontal run portions 28*b* and 30*b* for storing the door 20 in its open position and vertical run portions 28*c* and 30*c* for supporting the door in its closed position. A suitable counterbalance mechanism 34 is mounted on wall 26 generally above and adjacent to the door 20 and is connected to the door by spaced apart depending cables or similar suitable flexible members 35, also in a known manner. A preferred type of counterbalance mechanism 34 is disclosed in U.S. Pat. No. 6,134,835 issued Oct. 24, 2000 and assigned to the assignee of the present invention. Operator mechanism for moving the door 20 between open and closed positions may be of a conventional type, not shown.

Figure 2:
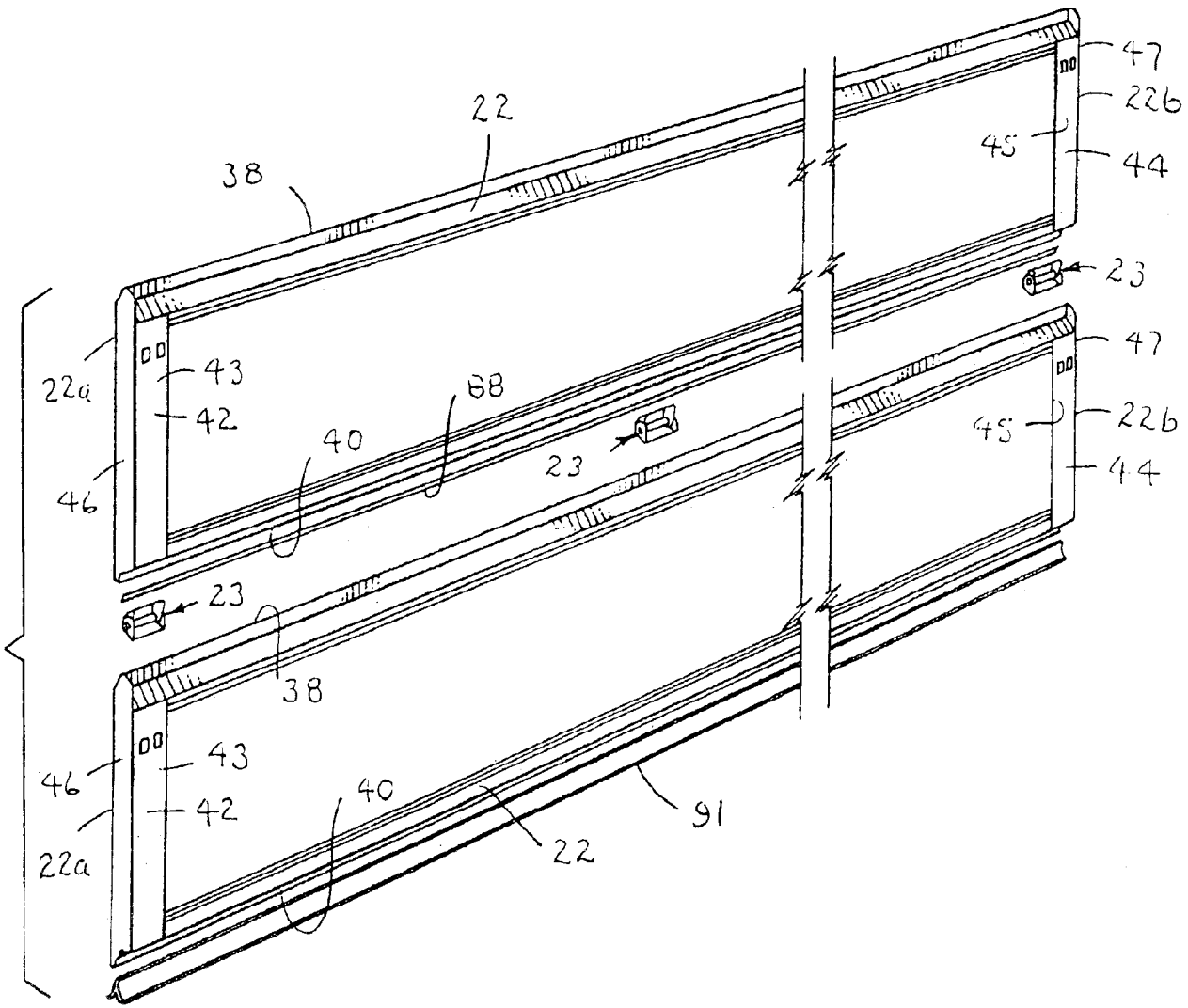
FIG. 2 is an exploded perspective view of two adjacent door panels, including the bottom panel of the sectional door shown in FIG. 1.
Figure 3:
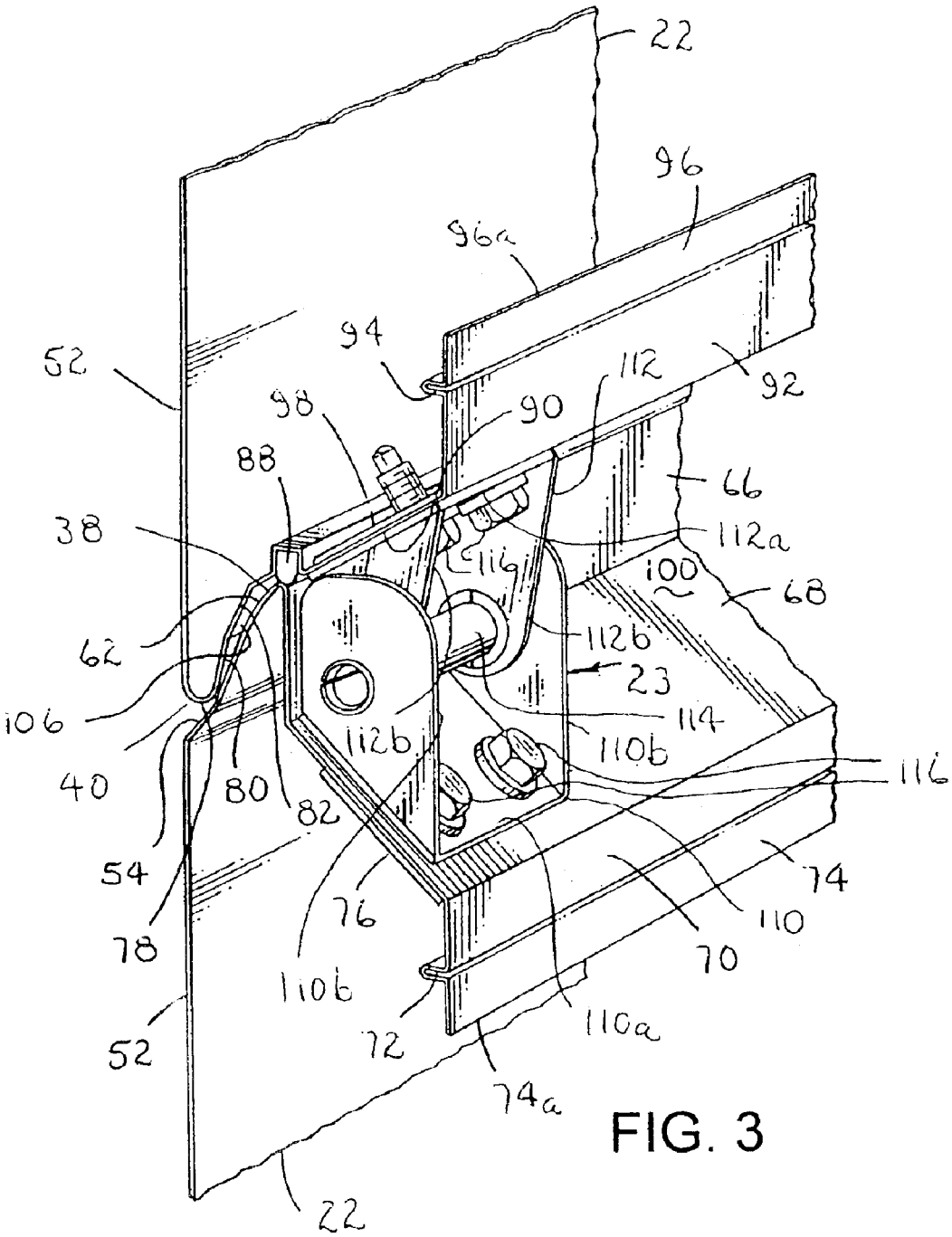
FIG. 3 is a detail perspective view of two adjacent panels of the door shown in FIG. 1 together with one embodiment of a hinge assembly for interconnecting the panels.

Referring to FIGS. 2 and 3 and FIG. 2, in particular, two adjacent panels 22 are shown in an exploded view wherein the hinge assemblies 23 are positioned spaced apart from each other and are adapted to interconnect the panels. Each of the panels 22 has an upper longitudinal edge 38 and a lower, generally parallel longitudinal edge 40. The panels 22 are preferably reinforced by structural members comprising opposed end stiles 42 and 44 having rearwardly facing flanges 43 and 45, respectively, and lateral flanges 46 and 47, respectively, for closing the side edges 22*a* and 22*b* of the panels. The stiles 42 and 44 are adapted to support guide member support brackets, not shown in FIG. 2, for supporting the guide members 32 shown in FIG. 1. The guide member support brackets are preferably a type to be described in further detail herein. Intermediate reinforcing members or stiles 50, see FIG. 1, may also be secured to the panels 22 and extending between the edges 38 and 40 of each panel. Intermediate stiles 50 are used, particularly, if the door panels are uninsulated whereby the panels require the additional support which otherwise is provided by insulation material.

Figure 4:
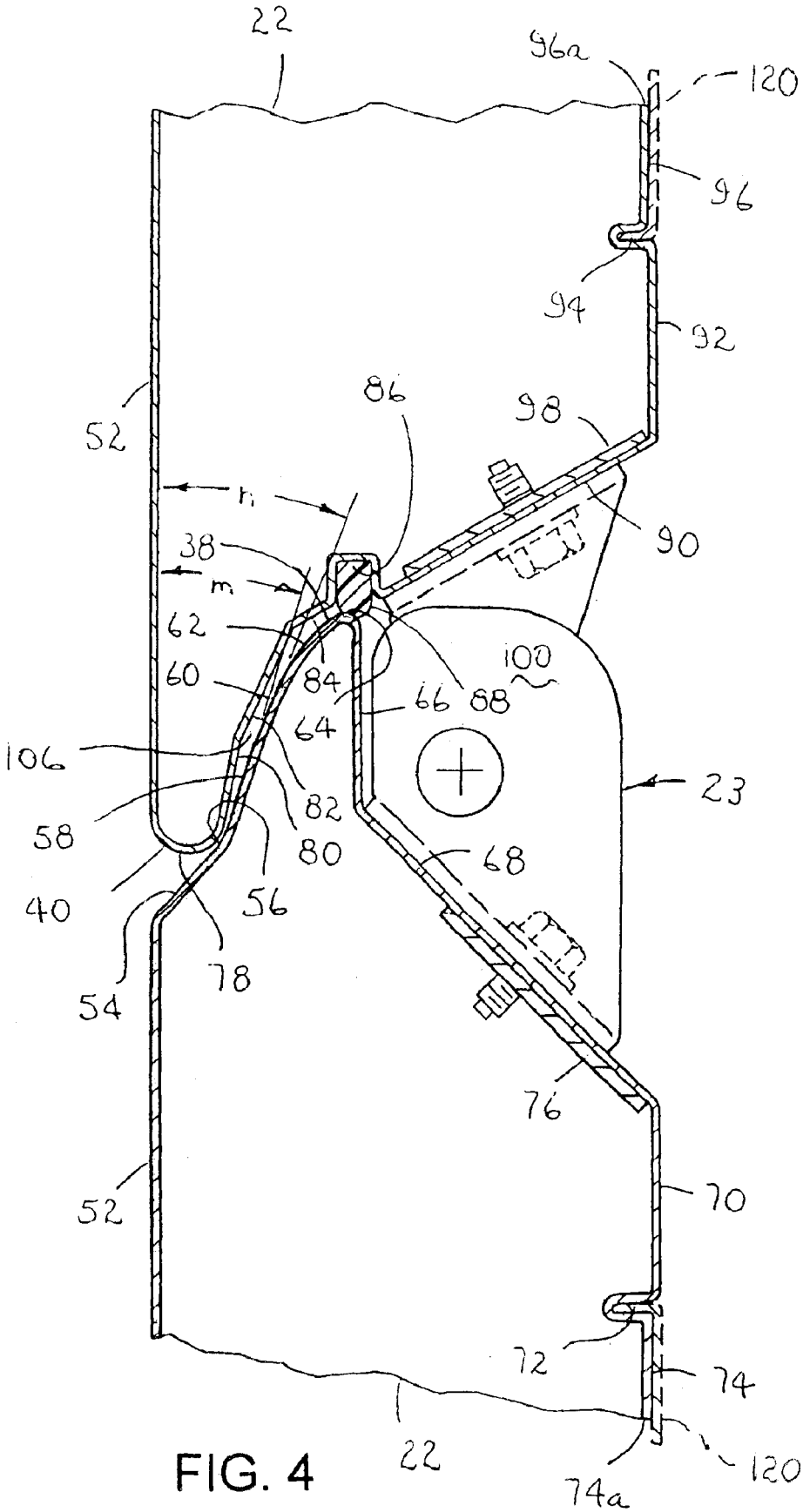
FIG. 4 is a detail section view taken normal to the panel hinge pivot axis and showing the configurations of the cooperating edges of the door panels which provide the pinch resistant profile.

Referring further to FIGS. 3 and 4, each panel 22 may be formed of a rolled or extruded metal or plastic sheet including a generally planar outer wall 52 extending between the top edge 38 and bottom edge 40. The top edge 38 of each panel is formed by a first inwardly sloping generally planar surface 54 which is contiguous with the outer surface 52 and also with a concave curvilinear surface 56, as shown in FIG. 4 in particular. Upper edge 38 is also formed by a further upwardly and rearwardly inclined surface 58, FIG. 4, which forms an angle "m" with planar surface 52 in a range of about 19° to 20°. Surface 58 is contiguous with a second upwardly and rearwardly inclined surface 60 which forms an angle "n" with the surface 52 of between about 23° to 25°. Surface 60 is contiguous with a convex curvilinear surface 62 having a substantially constant radius and which is also contiguous with a convex curvilinear surface 64 of significantly smaller radius of curvature with respect to surface 62 at the apex of the edge 38. Curvilinear surface 64 is further contiguous with a generally vertically extending planar surface 66 which is substantially parallel to surface 52 of panel 22 and is also contiguous with an inclined surface 68, preferably forming an angle of about 45° with respect to surface 52. Inclined surface 68 extends between vertical surface 66 and an inner, generally planar and downwardly extending wall part 70 which is parallel to surfaces 52 and 66.

Inner wall part 70 is intersected by a portion of panel 22 forming a groove 72 which extends generally normal to inner wall part 70 and outer panel wall part or surface 52. Finally, the upper end of each panel 22, preferably terminates in a further portion of inner wall part 74 which extends to a downwardly facing edge 74*a*. Generally planar inner wall part 74 is offset slightly toward outer wall part or surface 52 from inner wall part 70 or may be substantially coplanar with inner wall part 70. As further shown in FIG. 4, as well as FIG. 3, a generally planar reinforcing plate 76 extends along and is contiguous with inclined surface 68 for supporting suitable threaded fasteners for securing a lower leaf or plate member of the hinge assembly 23 to the inclined surface 68 of panel 22 in the manner shown in FIGS. 3 and 4.

Referring still further to FIG. 4, in particular, the lower edge 40 of each panel 22 is defined by a circular radius convex tip 78 contiguous with the outer wall part or surface 52 and with a generally planar upwardly inclined surface 80 which extends inwardly from the surface 52 at an angle in the range of about 11° to 12° with respect to the planar surface 52. Planar surface 80 is contiguous with a second planar surface 82 which extends inwardly toward the inner wall of panel 22 and at an angle of about 24° to 25° with respect to surface 52. A third generally planar surface 84 extends at a further steeper angle with respect to surface 52 to an elongated groove or recess 86 which extends the length of the edge 40 and is adapted to receive a resilient elastomeric seal member 88 forcibly retained therein or by means such as a suitable adhesive. As shown in FIG. 2, a flexible, elongated bottom edge seal strip 91 may be retained in groove 86 of the lowermost panel 22 to seal the bottom edge of door 20 against a floor surface, if desired.

A still further inclined surface 90 extends from groove 86 at an angle of about 60° with respect to surface 52 to an inner lower panel wall part 92 which extends upwardly toward wall part 70 and is coplanar therewith. Inner surface or wall part 92 is intersected by a transverse groove 94 extending normal thereto. Finally, a generally planar wall part 96 extends parallel to wall part 92 and may be slightly offset therefrom toward surface 52. Wall part 96 terminates at an upwardly facing edge 96*a*, viewing FIG. 4. A generally planar reinforcing plate 98 extends along the inside surface of panel wall part or surface 90 and is suitably adhered thereto to form a reinforcement for threaded fasteners adapted to secure the upper leaf or plate of hinge assembly 23 to the panel at the surface 90. The parts aforedescribed for edges 38 and 40 extend between side edges 22*a* and 22*b* of each panel 22.

Several benefits are achieved by the configurations of the cooperating top edges 38 and bottom edges 40 of the panels 22. As will be appreciated from viewing FIGS. 3 and 4, the configurations of the panel edges 38 and 40 provide for a cavity, generally designated by numeral 100 and defined generally by the surfaces or wall parts 66, 68 and 90 when the panels are mounted adjacent to each other and extend substantially coplanar with each other to receive the hinge assemblies 23 substantially within the confines of the panels. In other words, hinge assemblies 23 do not extend rearwardly of the surfaces or wall parts 70 and 92 to thereby provide a generally flush, unobstructed inner surface of the door 20. Pivot axis 102, FIG. 4, of each hinge assembly 23 is disposed between the inner surface of the door 20 defined by the panel surfaces or wall parts 70 and 92 and the outer surface or wall part 52. This location of the hinge pivot axis also minimizes the clearance requirements for the door 20 when the panels 22 articulate with respect to each other.

The geometry of the portion of the edge 38 defined by the surfaces 58, 60 and 62 is generally convex but not curved throughout its extent, primarily so as to facilitate ease of fabrication. Still further, the configuration of the edge 40 between the tip 78 and the groove 86 is somewhat concave but also not curvilinear, and therefore has no radius of curvature, also to facilitate fabrication. Thus the panel edge configurations 38 and 40 provide for ease of manufacture of the panels 22, provide adequate clearance between the edges 38 and 40 during articulation of the panels but also minimizes the gap between the edges 38 and 40 to prevent a person's fingers being inserted between the panels from either side of the door 20. The seal member 88 advantageously engages the edge 38 to provide a substantially weathertight seal when the door 20 is in a closed position and cushions the final stage of movement between door panels 22 when moving to the position shown in FIGS. 3 and 4.

As also shown in FIGS. 3 and 4, a variable thickness gap 106 is formed between the edges 38 and 40 in the closed position of the door 20 to provide adequate clearance between the edges 38 and 40 as the panels 22 articulate with respect to each other. However, the gap 106 is of reduced width, particularly at the point where the convex circular tip 78 is disposed adjacent the surfaces 54, 56, 58 to minimize the insertion of any object, including a person's fingers between the panels, and to assist in providing a weathertight joint between panels in the closed position of the door 20. Moreover, the concave, segmented configuration of the edge 40 provided by the surfaces 80, 82 and 84 maintains a sufficiently narrow gap distance between the tip 64 and the seal member 88 as well as the bottom edge 40 to prevent insertion of an object, including a person's fingers, between the door panels 22 from the inner side of the panels when the panels are articulating or pivoting with respect to each other. Moreover, the portion of the overall width of a panel 22 which is required for the portions of the edges 38 and 40 which provide the pinch resistant edge profile is less than about 50% of the overall width or thickness of the panel 22. This arrangement also simplifies manufacturing or fabrication of the panel and strengthens the panel edges against unwanted plastic deflection.

Referring again to FIG. 3, each hinge assembly 23 includes opposed hinge plates or leaves 110 and 112, both of which are generally channel shaped. Hinge plate 110 includes a base web 110*a* and spaced apart flanges 110*b* extending normal to web 110*a*. Hinge plate 112 includes a base web 112*a* and spaced apart flanges 112*b* extending normal to the web 112*a*. A cylindrical tubular hinge pin 114 extends through suitable bores in the flanges 10*b* and 112*b* and may be force fitted in the bores in the flanges 110*b* to retain the hinge plates 110 and 112 connected to each other. The hinge plates 110 and 112 are suitably connected to adjacent panels 22 by conventional hexhead self-tapping threaded fasteners 116 extending through suitable bores in the webs 110*a* and 112*a* and through the wall parts or surfaces 68 and 90 as well as the reinforcing plates 76 and 98 to provide a hinge connection between panels 22.

Figure 5:
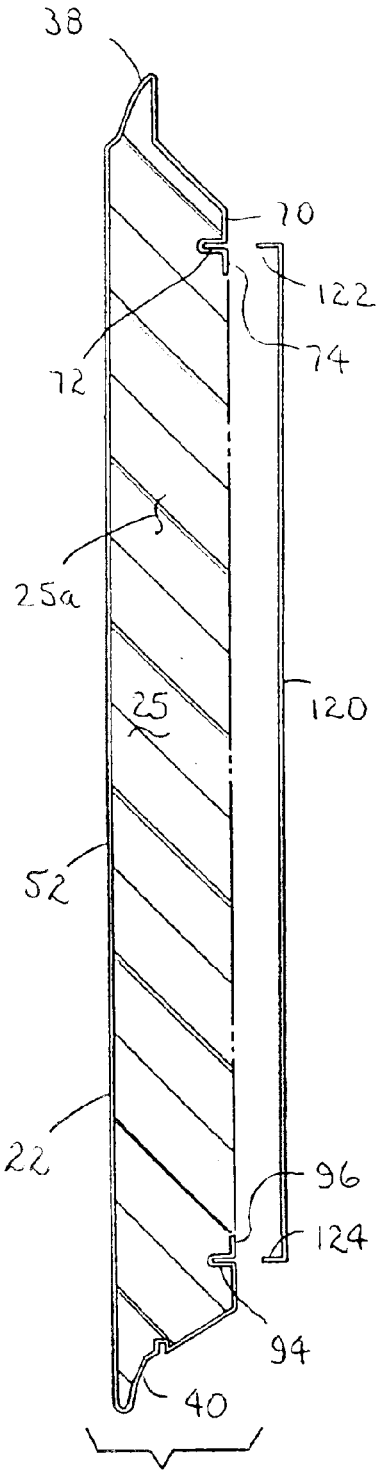
FIG. 5 is a section view of a fully insulated door panel in accordance with the invention with a rear skin or backer member removed therefrom.

Referring now to FIG. 5, the panels 22 may be modified to be further reinforced and to have additional insulative properties by filling a cavity 25 between the top and bottom edges 38 and 40 with a suitable insulative foam material 25*a*. The cavity 25 is preferably closed by a generally planar sheet backer member 120 formed of steel, plastic or a metal foil Kraft paper composite, for example. Backer member 120 includes opposed generally parallel short flanges 122 and 124 insertable in the grooves 72 and 94. The backer member 120 is preferably secured to the insulative foam 25*a* and wall parts or surfaces 74 and 96 by a suitable adhesive.

Figure 6:
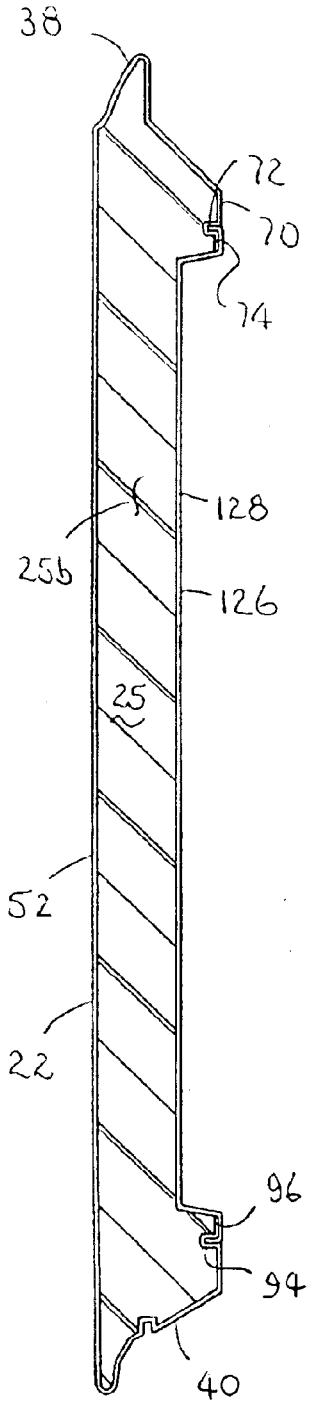
FIG. 6 is a section view of a partially insulated door panel in accordance with the invention.
Figure 7:
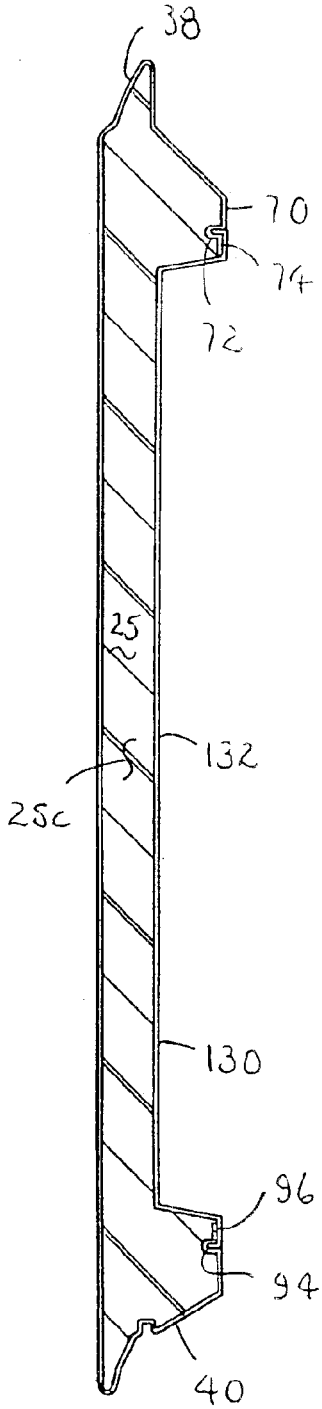
FIG. 7 is a section view of another partially insulated door panel in accordance with the invention.

FIG. 6 illustrates a further modified panel 22 wherein a backer panel or member 126 similar to the backer 120 is provided but is of a configuration which includes a planar wall part 128 which is recessed inwardly toward the surface 52 to reduce the thickness of an insulation foam layer 25*b* from that of the panel embodiment shown in FIG. 5. FIG. 7 illustrates a further embodiment of panel 22 wherein a backer member 130 includes a planar wall part 132 recessed even further toward the surface 52 to further reduce the thickness of an insulation foam layer 25*c*. The backer members 126 and 130 are otherwise constructed like the backer member 120 including opposed flanges insertable in the grooves 72 and 94 and being adapted to be adhered to the inner wall parts or surfaces 74 and 96.

Figure 8:
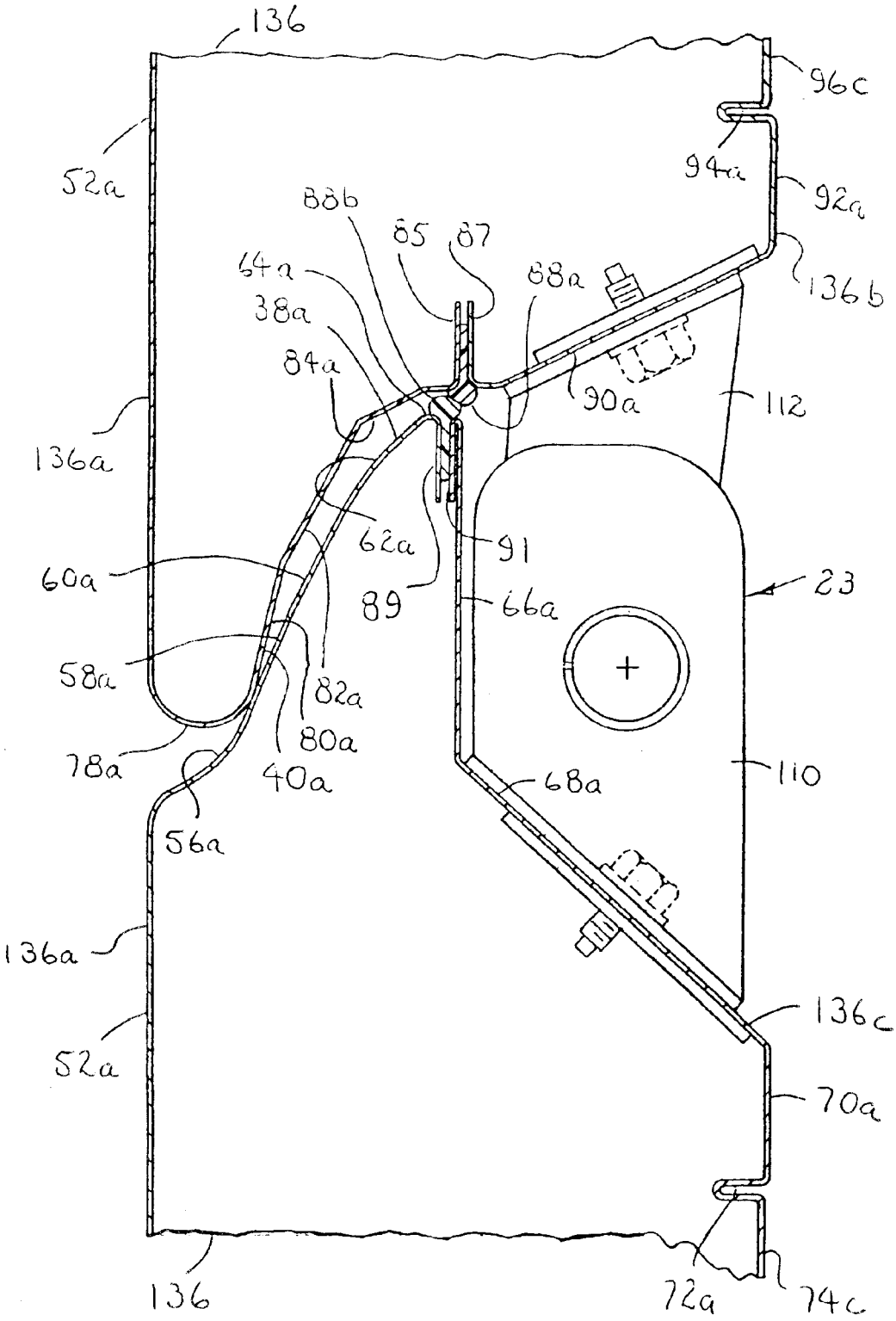
FIG. 8 is a detail section view similar to FIG. 4 showing another embodiment of a door panel in accordance with the invention.

Referring now to FIG. 8, an alternate embodiment of a door panel in accordance with the invention is illustrated by showing the upper and lower edges of adjacent panels. The panels of the embodiment of FIG. 8 are generally designated by the numerals 136 and have outer, generally planar, wall parts or surfaces 52*a*. Upper and lower panel edges 38*a* and 40*a* are formed with cooperative edge surfaces substantially like the panels 22, that is, lower edge 40*a* includes a tip 78*a* and contiguous surfaces 80*a*, 82*a* and 84*a* having generally the same geometry with respect to the surface 52*a* as the corresponding surfaces of the panel 22. However, the panel member portion making up the surfaces 52*a*, 78*a*, 80*a*, 82*a* and 84*a* terminates in a flange portion 85 extending generally parallel to surface 52*a*. Each panel 136 is formed of a second panel part delimited by a Flange 87 spaced from the flange 85 and contiguous with an inclined surface 90*a* which extends to surfaces 92*a*, 96*c*, which are intersected by a groove 94*a*, as shown in FIG. 8. The panel parts 136*a* and 136*b* are secured together at the flanges 85 and 87 by an elongated resilient elastomeric gasket or seal member 88*a* disposed between flanges 85 and 87, and secured thereto by a suitable adhesive.

Referring further to FIG. 8, in like manner the edge 38*a* extends inwardly from outer surface or panel wall part 52*a* and is formed by a concave curvilinear surface 56*a* and contiguous surfaces 58*a*, 60*a* and 62*a* having geometry similar to the surfaces 58, 60 and 62 of the panel 22. However, surface 62*a* is contiguous with a convex curved apex or tip 64*a* which is also contiguous with a planar distal flange 89 extending generally parallel to surface 52*a*. The upper edge of a third panel part 136*c* is formed by an in-turned flange 91 forming the terminal part of rear panel surface 66*a* which is contiguous with an inclined surface 68*a*. Surface 68*a* terminates in a generally planar inner wall part or surface 70*a* similar to surface 70. A groove 72*a* and wall part 74*c* further define panel part 136*c*. An elongated elastomeric gasket or seal member 88*b* is sandwiched between and suitably secured to the flanges 89 and 91 to join the panel parts 136*a* and 136*c* together at the upper edge 38*a*. As shown in FIG. 8, when adjacent panels 136 are interconnected by hinge assemblies 23, for example, and pivoted to the door closed position wherein the panels are substantially coplanar, the gasket or seal members 88*a* and 88*b* engage each other to form a substantially weathertight seal. The panels 136 may be hinge together by a hinge assembly 23 or by other embodiments of improved hinge assemblies in accordance with the invention to be described in further detail herein. One advantage of the panel 136 is the provision of a thermal break between the outer panel part 136*a* and the inner panel parts 136*b* and 136*c*, as provided by the combination gasket and seal members 88*a* and 88*b*.

Figure 9:
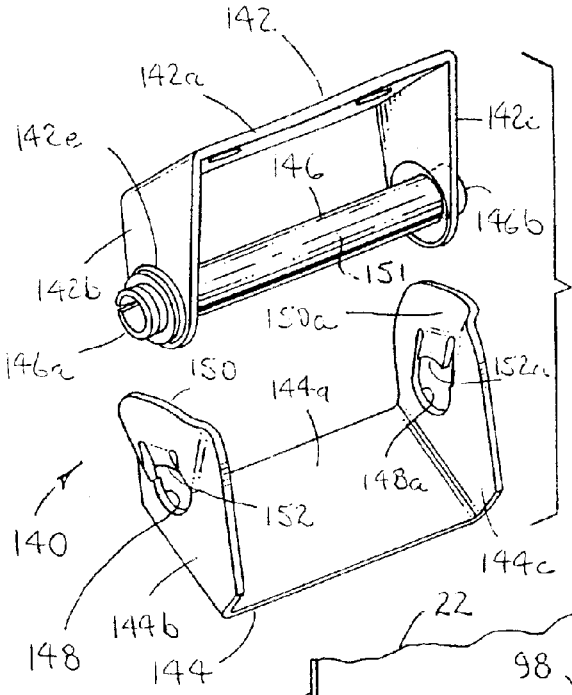
FIG. 9 is an exploded perspective view of one preferred embodiment of a hinge assembly in accordance with the present invention.
Figure 10:
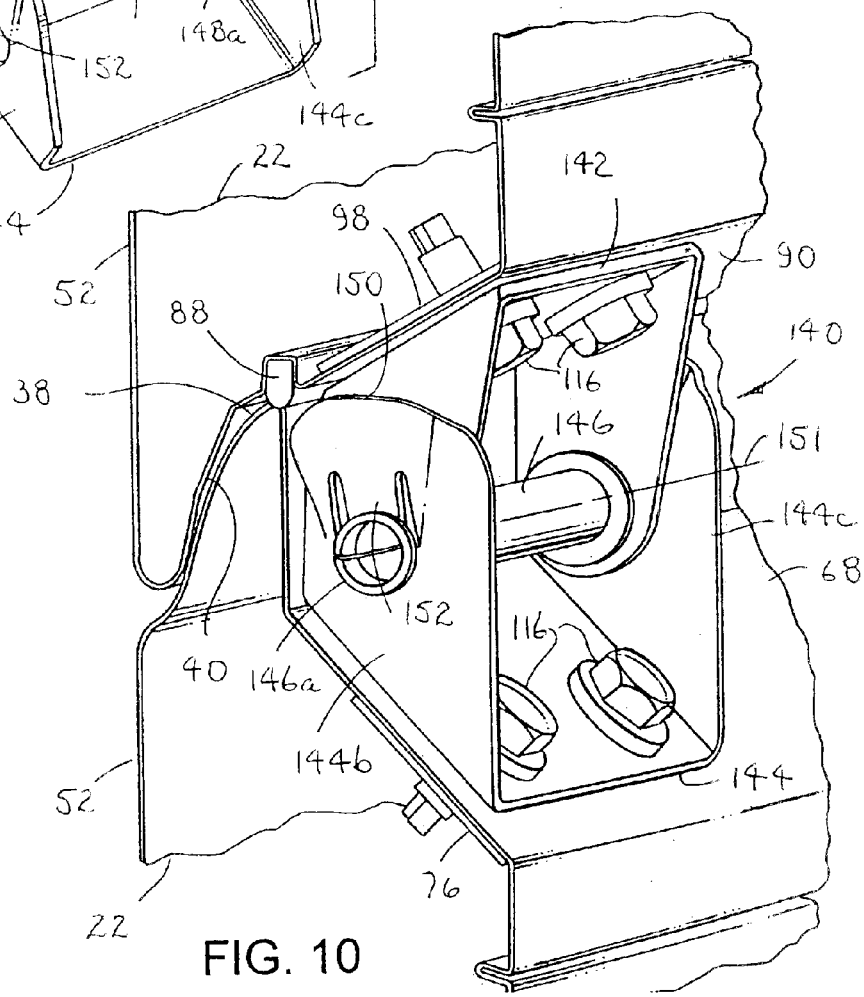
FIG. 10 is a perspective view of the hinge assembly shown in FIG. 9 assembled and connected to adjacent door panels.

Referring now to FIGS. 9 and 10, a preferred embodiment of a hinge assembly useful with the sectional door 20, as well as certain other sectional doors, is illustrated and generally designated by the numeral 140. The hinge assembly 140 includes upper and lower hinge leaves or plates 142 and 144 adapted to be secured, respectively, to the panel wall parts or surfaces 90 and 68, as illustrated in FIG. 10. The upper hinge plate 142 is a substantially channel shaped member having a base web 142*a* and opposed generally parallel flanges 142*b* and 142*c*, FIG. 9, which extend normal to web 142*a* and are provided with suitable bores for receiving an elongated cylindrical tubular hinge pin 146 extending between and supported by the flanges 142*b* and 142*c*. The hinge pin 146 includes opposed distal ends 146*a* and 146*b* which project outwardly from the flanges 142*b* and 142*c*, as shown in FIG. 9. The pin distal ends 146*a* and 146*b* may be flared slightly radially outwardly and disposed adjacent suitable reinforcing collars 142*e*, one shown in FIG. 9, disposed between the pin distal ends and the flanges 142*b* and 142*c*, respectively.

The hinge plate 144 is also a generally channel shaped member having a base web 144*a* and upturned parallel flanges 144*b* and 144*c* spaced apart and extending generally normal to the web 144*a*. Flange 144*b* is provided with a pin receiving bore 148 and a generally outwardly flared funnel-like wall portion 150 providing a sloped recess for guiding the distal end 146*a* of pin 146 into the bore 148. An elastically deflectable pin retainer tab 152 defines part of the bore wall of the bore 148 and also forms part of the guide or wall portion 150 of flange 144*b*. Flange 144*c* is provided with a bore 148*a* coaxial with bore 148, and an outwardly flared funnel wall portion 150*a* of flange 144*c* including an elastically deflectable pin retainer tab 152*a*. Accordingly, flange 144*c* comprises a mirror image of flange 144*b*.

Hinge plates 142 and 144 may be secured together to provide the hinge assembly 140, as shown in FIG. 10, by preferably first securing the hinge plates 142 and 144 to the respective wall parts or surfaces 90 and 68 with fasteners 116, for example. Then, when one panel 22 is desired to be stacked on top of another panel 22, generally in the position shown in FIG. 10, the panels are moved relative to each other, while being maintained substantially coplanar, to bring edges 38 and 40 adjacent each other while the opposed distal ends 146*a* and 146*b* of pin 146 are guided by the flared wall portions 150 and 150*a* until the tabs 152 and 152*a* are deflected sufficiently to allow the pin distal ends to snap into the bores 148 and 148*a*. The flared portions 150 and 150*a* are spaced apart sufficiently such that the pin 146 may be inserted therebetween and gradually forcibly engage the flared portions and elastically deflecting flanges 144*b*, 144*c* and the tabs 152 and 152*a*. When the pin 146 is secured to the hinge plate 144, as shown in FIG. 10, the tabs 152 and 152*a* engage the pin distal ends 146*a* and 146*b*, respectively, to retain the pin 146 in the bores 148 and 148*a* and secured to the hinge plate 144 to form the hinge assembly 140.

Accordingly, in this way two door panels 22 may be assembled to each other by aligning one panel with the other and inserting the hinge pin distal ends into the bores of the hinge plates 144 in the manner just described to essentially snap the hinge plates 142 and 144 of the hinge assemblies 140 together to form the hinge assemblies and to secure the door panels 22 to each other for pivotal movement about the longitudinal central axes 151 of the hinge pins 146. If it is desired to disassemble the hinge assembly 140, the elastically deflectable tabs 152 and 152*a* may be deflected outwardly away from each other by a suitable tool, not shown, sufficiently to clear the distal ends 146*a* and 146*b* of pin 146 whereby the hinge plate 142 may be lifted out of engagement of the pin 146 with the flanges 144*b* and 144*c* by reversing the direction of movement of the hinge pin with respect to the hinge plate 144, as described above. Hinge pin 146 may comprise integral or separately fabricated trunnions disposed on the flanges 142*b* and 142*c* and forming the pin distal ends 146*a* and 146*b*, respectively, if desired, instead of use of the continuous tubular pin, as shown.

Figure 11:
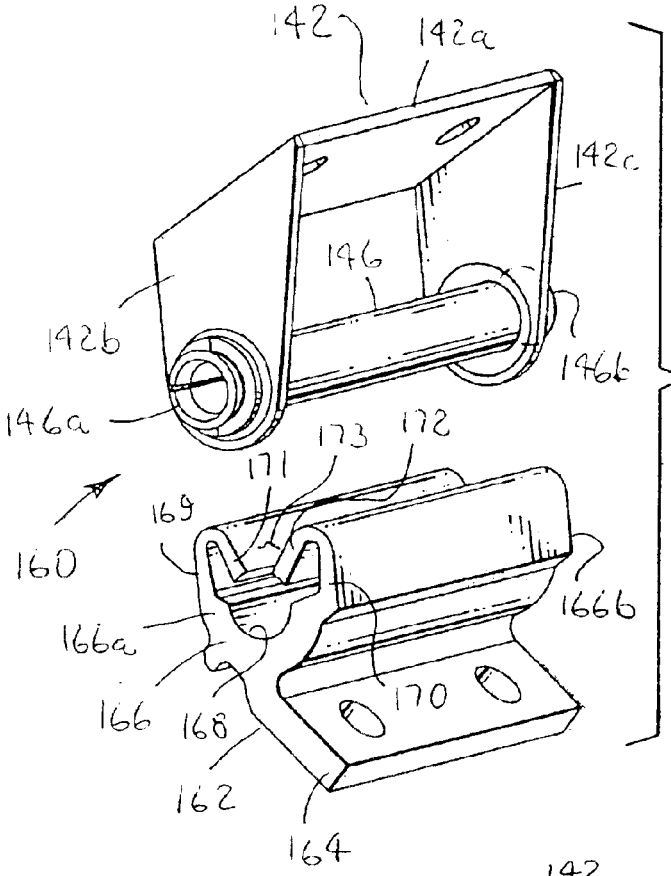
FIG. 11 is an exploded perspective view of a first alternate embodiment of a hinge assembly in accordance with the invention.
Figure 12:
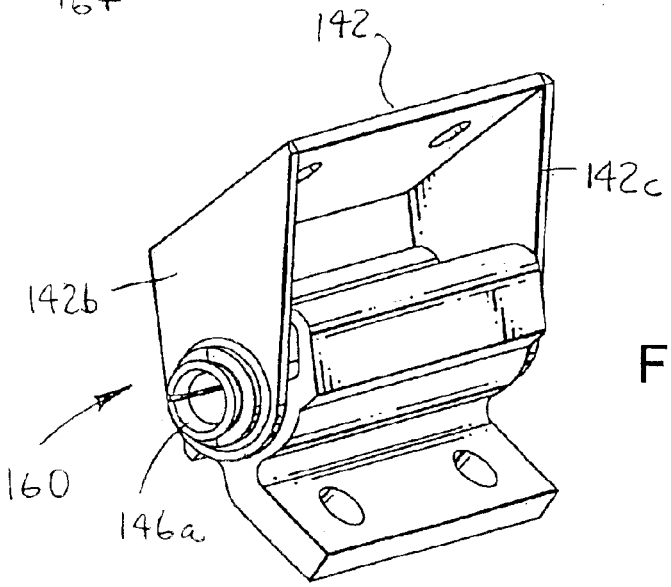
FIG. 12 is a view of the hinge assembly of FIG. 11 in an assembled condition.

Referring now to FIGS. 11 and 12, a first alternate embodiment of a snap together hinge assembly in accordance with the invention is illustrated and generally designated by the numeral 160. The hinge assembly 160 advantageously utilizes the hinge plate 142 and pin 146 but includes a substantially modified pin receiving hinge plate or leaf 162. Hinge plate 162 includes a mounting flange 164 comprising a generally flat rectangular plate-like part which is integrally joined with a semicylindrical bearing part 166 having a pin receiving bearing bore 168 formed therein, FIG. 11, and extending between opposite sides 166*a* and 166*b* of bearing part 166. Bearing part 166 is dimensioned such that hinge plate 162 may be disposed between flanges 142*b* and 142*c*, as shown in FIG. 12. Bearing part 166, FIG. 11, includes opposed spaced part upstanding wall parts 169 and 170 which are integrally formed with in-turned opposed pin retainer fingers 171 and 172 which are inclined toward each other to form a somewhat V-shaped slot 173 which opens toward bearing bore 168. The opposed fingers 171 and 172 of the wall parts 169 and 170 are elastically deflectable toward their integral supporting wall parts 169 and 170 to provide sufficient clearance to allow a hinge pin 146 to be received in pin bearing bore 168. The elastically deflectable parts or fingers 171, 172 are dimensioned to further define the bore 168 so that once the pin 146 has passed through the slot 173 and deflected the fingers 171 and 172 sufficiently to be disposed in the bore 168, the fingers 171 and 172 snap back into the positions shown in FIG. 11 to retain the pin 146 in bearing bore 168 and firmly attached to hinge plate 162.

Accordingly, the hinge assembly 160 also forms a snap together hinge, as illustrated in FIG. 12, whereby movement of the hinge plate 160 toward the hinge plate 162 somewhat forcibly will enable the hinge pin 146 to momentarily elastically deflect the fingers 171 and 172 sufficiently to allow the pin to move into the bore 168 whereby the tabs then return to their original undeflected positions to retain the pin in the bore. As with the hinge assembly 140 shown in FIGS. 9 and 10, a suitable tool may be provided to elastically deflect the fingers 171 and 172 to enable the hinge plates 142 and 162 to be separated if it is desired to disassemble the hinge assembly 160.

Figure 13:
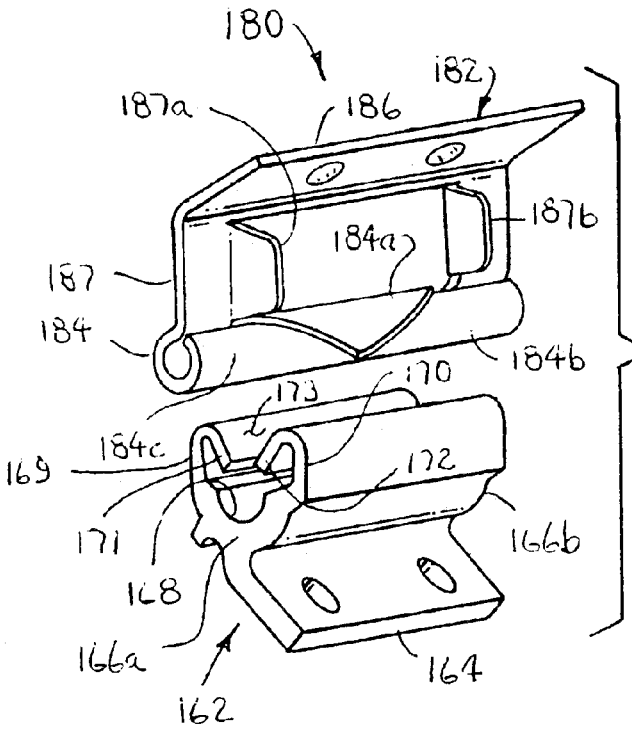
FIG. 13 is an exploded perspective view of a second alternate embodiment of a hinge assembly in accordance with the present invention.
Figure 14:
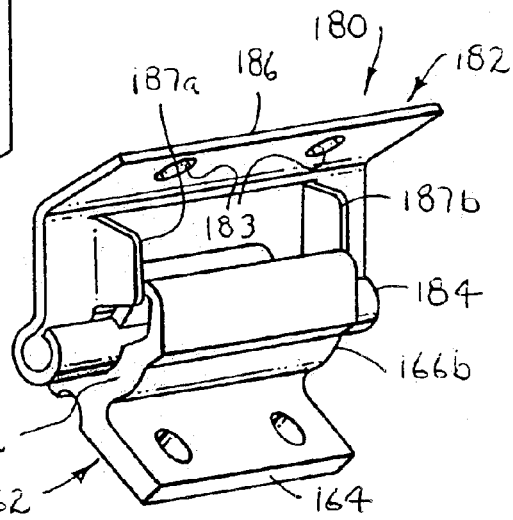
FIG. 14 is a perspective view of the hinge assembly of FIG. 13 in an assembled condition.
Figure 16:
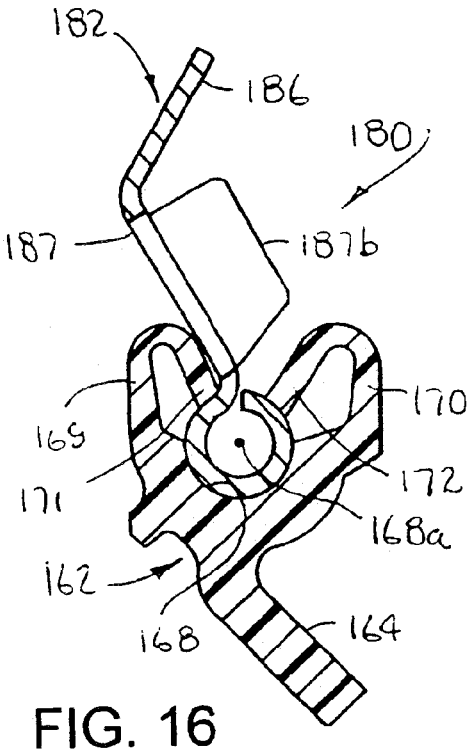
FIG. 16 is a detail section view taken from the line 16—16 of FIG. 14 and showing the upper hinge leaf rotated to an alternate position.

Referring now to FIGS. 13, 14 and 16, a second alternate embodiment of a snap together hinge assembly in accordance with the present invention is illustrated and generally designated by the numeral 180. The hinge assembly 180 advantageously utilizes the lower hinge plate 162 but includes a one piece hinge plate or leaf 182 having an integral hinge pin 184 formed thereon. Hinge plate 182 includes a generally planar and rectangular web part 186 formed with suitable bores 183 therein for receiving fasteners 116 to secure the hinge plate 182 to the wall part or surface 90, for example, of a panel 22. Web part 186 is integrally joined with a wall part 187 which, in turn, is integrally formed with the pin 184. Opposed hinge locating and restraining tabs 187*a* and 187*b* project normal the plane of the wall part 187 and are engageable with opposite end faces 166*a* and 166*b* of the hinge plate 162, FIG. 14, to restrain axial displacement of the hinge plates relative to each other to prevent lateral disassembly of the hinge members of hinge assembly 180 when the hinge plates or leaves 162 and 182 are in the position of these members indicated in FIG. 14 or when the hinge plates are rotated relative to each other during normal movement of the door panels between door open and closed positions of the door.

However, as shown in FIG. 16, the hinge plates 162 and 182 may be rotated relative to each other so that the restraining tabs 187*a* and 187*b* as well as the wall part 187 may be disposed between the fingers 171 and 172, as shown. In this position of the hinge plates 162 and 182 relative to each other, the plates may be separated by sliding the pin 184 out of the bore 168 along the bore axis. The hinge plates 162 and 182 would, normally, be disassembled from the door panels 22 before separation from each other in the manner just described. Tabs 187*a* and 187*b* may be integrally formed as part of the entire integral hinge plate 182 by suitable stamping operations, for example.

Figure 15:
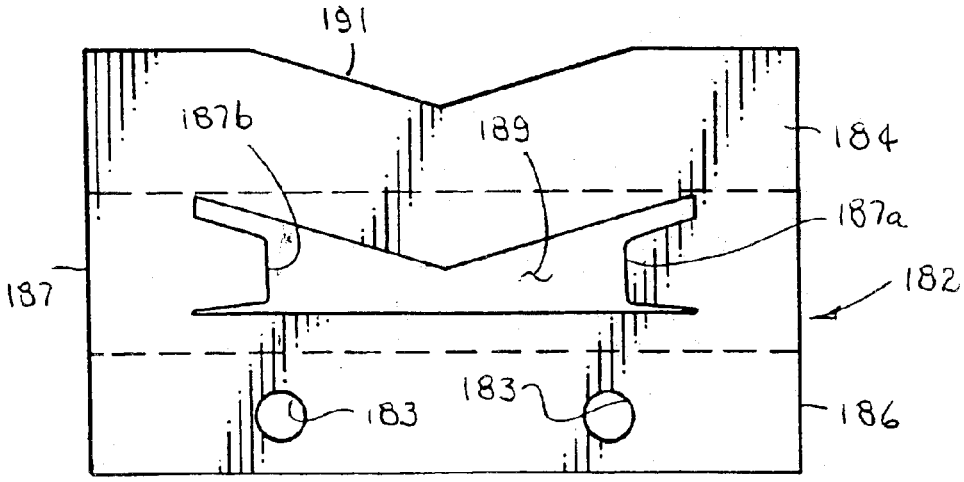
FIG. 15 is developed plan view of one of the hinge leaves of the hinge assembly shown in FIGS. 13 and 14.

Referring briefly to FIG. 15, which is a developed plan view of the hinge plate or leaf 182, the hinge plate 182 may be formed by removing metal to form the irregular shaped opening 189 and the inverted V-shaped recess 191 which corresponds in shape, substantially, to the triangular shaped part 184*a* of pin 184. Accordingly, when the larger generally rectangular part 184*b* and part 184*a* are rolled in opposite directions, the cylindrical hinge pin 184 may be formed and a somewhat chevron-shaped groove or slot 184*c*, see FIG. 13, is formed which is advantageous and eliminates, substantially, the chance of snagging the hinge pin 184 by the distal ends of the fingers 171 or 172 when the hinge assembly 180 is working.

As illustrated in FIG. 14, the hinge assembly 180 may be snapped together at any time, or once the respective hinge plates 162 and 182 have been secured to the respective top and bottom edges of adjacent door panels in the same manner as the embodiments of FIGS. 9 through 12. The fingers 171, 172 are deflected by forcing the pin 184 into the bearing bore 168 while allowing the fingers 171 and 172 to be elastically returned to their normal working positions shown in FIGS. 13, 14 and 16, thanks to the elastic memory the fingers 171 and 172 retain as being formed of part of the spaced apart wall portions 169 and 170. Thanks also to the provision of the spaced apart tabs 187*a* and 187*b*, the hinge plate 182 may not be laterally displaced out of engagement with the hinge plate 162 during normal operation of the hinge assembly 180.

Those skilled in the art will appreciate that the hinge assemblies 140 and 160 are prevented from lateral disengagement since the flanges 142*b* and 142*c* of the hinge plate 142 are operable to engage the flanges of plate 144 or, respectively, the opposite side faces 166*a* and 166*b* of hinge plate 162. Of course, with respect to all of the embodiments disclosed in FIGS. 9 through 14, these hinge assemblies may be secured to the door panels in the manner that the hinge assembly 23 is secured, that is, by aligning the panels initially and securing the hinge plates to the respective edges of adjacent panels with fasteners 116, for example, with the respective hinge plates already secured to each other to form the hinge assemblies. However, a major advantage of the hinge assemblies 140, 160 and 180 is the provision of the snap together feature which allows the door panels to be prefabricated with the hinge plates of the respective hinge assemblies secured to the respective bottom and top edges of adjacent panels, if desired.

Figure 17:
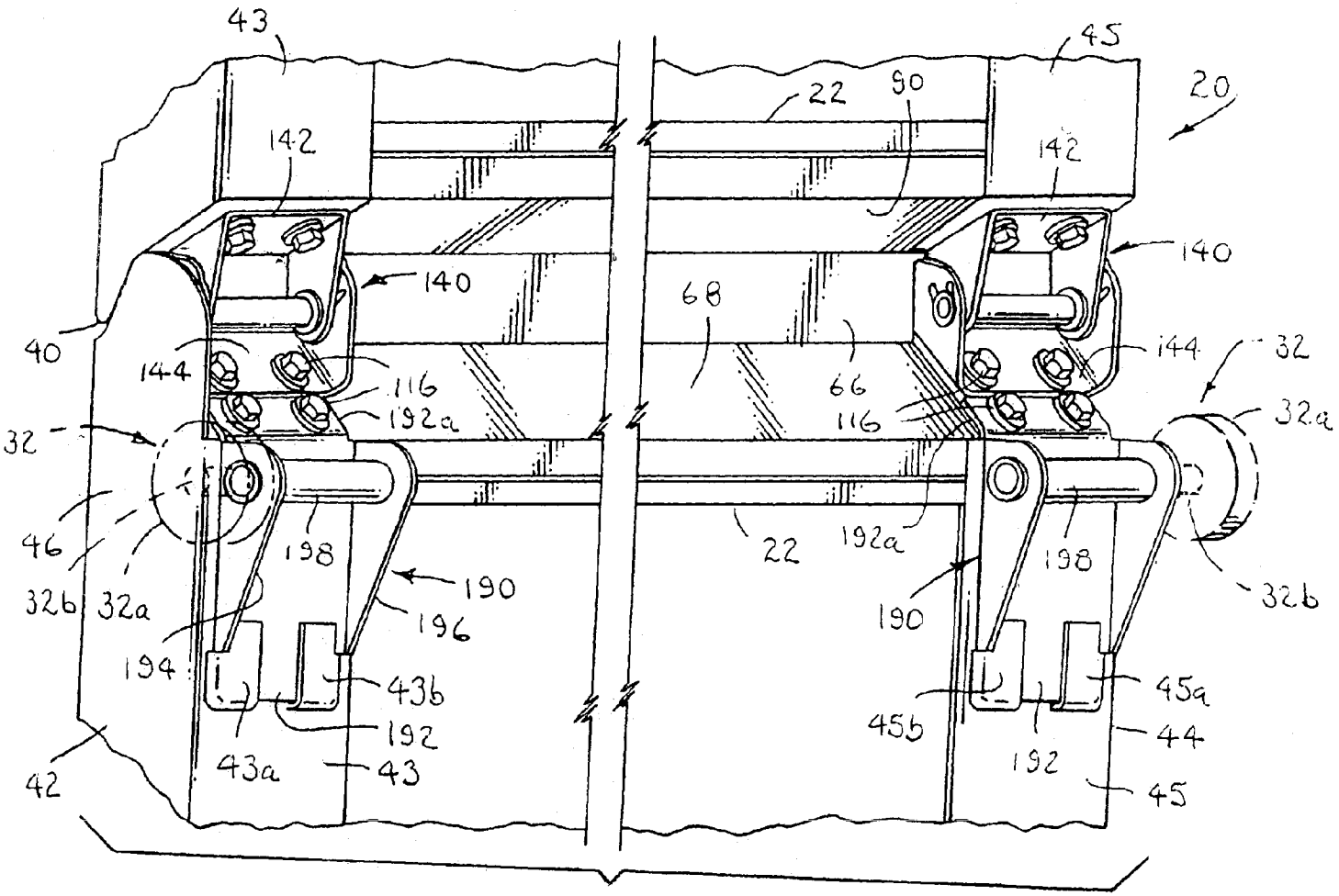
FIG. 17 is a perspective view of two adjacent door panels shown connected by one embodiment of hinge assemblies in accordance with the invention and also showing two opposed guide member support brackets in accordance with the invention.

Referring now primarily to FIG. 17, a portion of the sectional door 20 is illustrated including two adjacent panels 22 which are connected to each other by hinge assemblies 140, as illustrated. The door 20 is also advantageously provided with spaced apart guide member support brackets 190 secured to the respective end stiles 42 and 44 in a unique manner, as will be described hereinbelow, and also secured to the inclined surface 68 of the panel upper edge, as illustrated, by fasteners 116, respectively. The brackets 190 are each adapted to support a guide member, such as a roller assembly 32, each of which includes a roller 32*a* supported for rotation on a shaft 32*b*. Each of the brackets 190 includes a substantially planar base or web part 192 and opposed parallel flanges 194 and 196 which extend normal to the web part 192 and support a substantially tubular bearing member 198 extending therebetween. Tubular bearing member 198 is adapted to support the shaft 32*b* of a roller assembly 32, as shown in FIG. 17. The base or web 192 of each bracket 190 also includes an inclined portion 192*a* adapted to receive the fasteners 116 for securing the brackets, respectively, to the inclined surface 68 of the upper edge of a panel 22, as shown.

Figure 18:
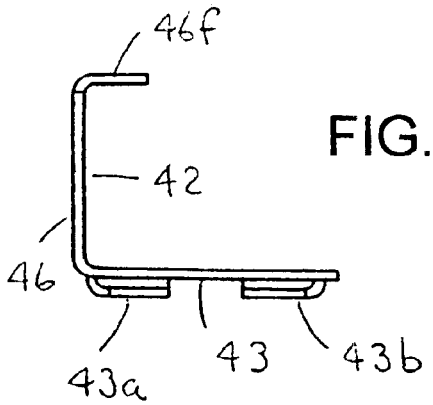
FIG. 18 is an end elevation of one of the end stiles for supporting the guide member support brackets shown in FIG. 17.
Figure 19:
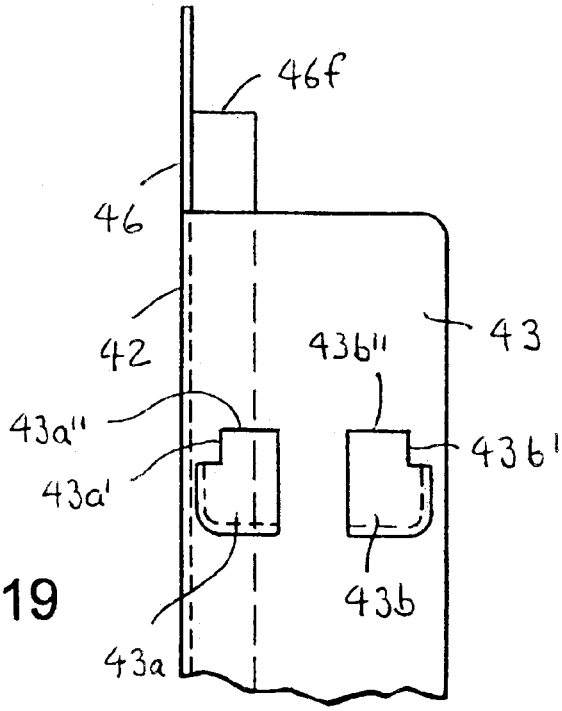
FIG. 19 is a detail side elevation of a part of the end stile shown in FIGS. 17 and 18.
Figure 20:
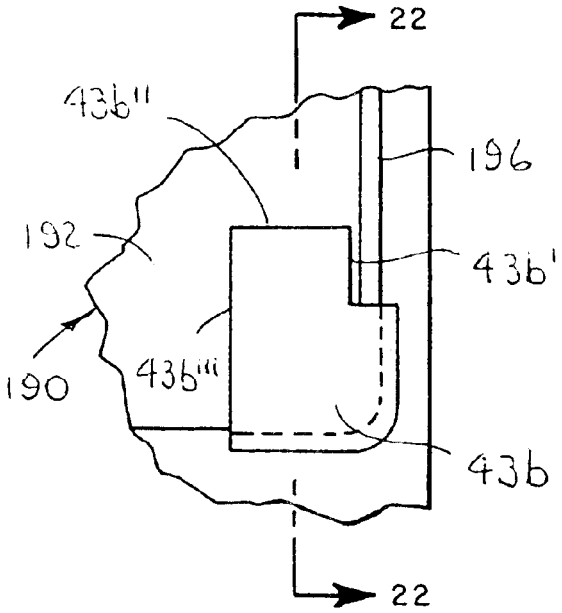
FIG. 20 is a detail view showing the configuration of one of the guide member bracket support tabs for the stile member shown in FIGS. 18 and 19.

As further shown in FIG. 17, as well as FIGS. 18 through 20, each of the end stiles 42 and 44 is adapted to receive the base or web part 192 of a bracket 190, respectively, secured to the stile by inserting a lower portion of the web 192 into receiving slots formed by laterally displaced and integrally formed retaining tabs 43*a*, 43*b* and 45*a*, 45*b* formed on the respective flanges 43 and 45. The end stiles 42 and 44 are substantially mirror images of each other and a further description of the end stile 42 is believed to be sufficient to enable one to practice the invention, including provision of the end stile 44.

Referring primarily to FIGS. 18 through 20, the end stile 42, as shown in FIG. 18, has a cross section which includes the flanges 43 and 46 and a short flange 46*f* extending generally parallel to the flange 43. The tabs 43*a* and 43*b* are displaced slightly outwardly from the plane of the flange 43 on the side of the flange 43 opposite the side which faces the flange 46*f*. The tabs 43*a* and 43*b* are formed by cutting the flange 43 along lines 43*a*', 43*a*" and 43*a*'", as well as along lines 43*b*', 43*b*" and 43*b*'", as also shown in FIG. 20. Accordingly, the tab 43*b* is unsupported along the edges which correspond to the lines 43*b*', 43*b*" and 43*b*'" to allow insertion of a corner of the lower portion of the web 192 of a bracket 190 to be supported by the tab, as also shown in FIG. 20. Tabs 43*a* and 43*b* also prevent lateral displacement of the bracket 190 out of the slots formed by the tabs. Accordingly, a suitable die forming or other metal displacing operation may be performed to form the tabs 43*a* and 43*b* on the flange 43 as well as the tabs 45*a* and 45*b* on the flange 45 of end stile 44.

Figure 22:
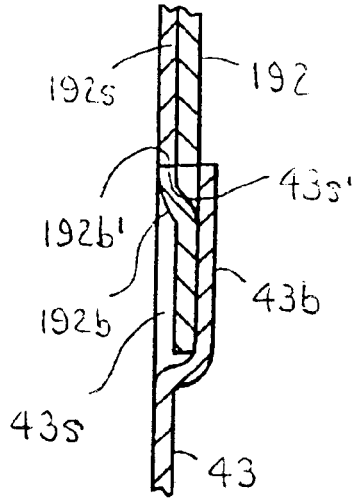
FIG. 22 is a detail section view taken generally along the line 22—22 of FIG. 20.
Figure 21:
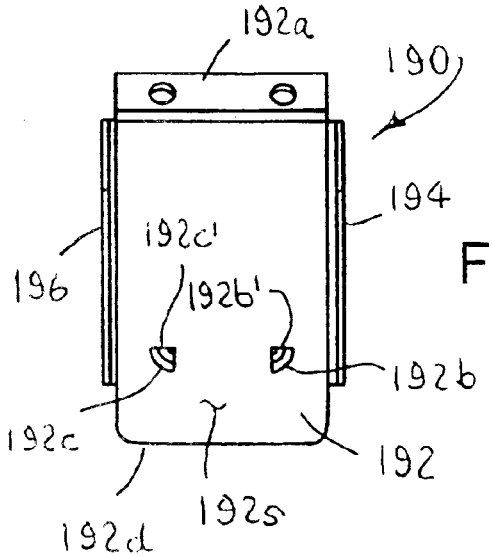
FIG. 21 is a rear elevation of a guide member support bracket.

Referring now to FIG. 21, an elevation view of the bracket 190 is shown wherein it is indicated that two integral bosses 192*b* and 192*c* are formed on the web 192 suitably spaced from lower edge 192*d*. Bosses 192*b* and 192*c* are preferably formed by displacing and partially shearing the material of the web 192 to form co-linear surfaces 192*b*' and 192*c*', respectively, see FIGS. 21 and 22. The bosses 192*b* and 192*c* project from the surface 192*s* of the web 192 in the direction of inclination of the web part 192*a* and are configured to allow snapping the bosses into the slots in the flange 43 which are formed by displacing the material of the flange 43 to form the tabs 43*a* and 43*b*. FIG. 22 illustrates the manner in which the bracket 190 may be disposed in engagement with the flange 43 of the stile 42 wherein, for example, the tab 43*b* is shown displaced from the plane of the flange 43 to form the elongated slot and opening 43*s* adapted to receive the web 192 of a bracket 190 and whereby the boss 192*b* may reside in the opening 43*s* with its edge 192*b*' engaged with a flange surface 43*s*'.

Accordingly, by inserting the web 192 of a bracket 190 between the tabs 43*a* and 43*b* and the flange 43, for example, the bracket may be forcibly engaged with and retained on the stile 42 by placement of the bosses 192*b* and 192*c* in the openings formed by the respective tabs 43*a* and 43*b* as shown and described for the tab 43*b*, for example. In this way, a bracket 190 may be moved into position adjacent the flange 43 or 45 of an end stile and then moved downwardly by sliding action until the bracket web 192 slides between the tabs of the associated flange and until the bosses are forcibly engaged with the flange in the manner described above to essentially lock the bracket 190 to a panel 22. After inserting the web 192 of a bracket 190 into engagement with the associated retaining tabs on a stile 42 or 44 and in the positions shown in FIG. 17, the fasteners 116 may be applied to retain the bracket firmly attached to a panel 22. When it is desired to remove a bracket 190 from a panel 22, the fasteners 116 are removed and the bracket is then deflected away from the stile flange 43, for example, sufficiently to elastically deflect the tabs 43*a* and 43*b*, to allow the bosses to clear the edges 43*s*' to remove the bracket from the door panel.

Accordingly, an improved assembly method for a sectional door panel may be carried out utilizing one of the hinge assemblies such as a hinge assembly 140, 160 or 180 for interconnecting two adjacent panels and by also utilizing panels configured as illustrated in FIG. 17, including the guide member retaining and support brackets 190. For example, viewing FIGS. 1 and 17, the lowermost panel 22 of the door 20 may be placed in position between the guide tracks 28 and 30 and connected to the guide tracks by guide members 32 which are connected to panel bottom edge guide member support brackets substantially like those disclosed in my U.S. Pat. No. 6,263,948 issued Jul. 24, 2001, and assigned to the assignee of the present invention, which application is hereby incorporated herein by reference. The upper edge 38 of lowermost panel 22 may then be suitably secured in place between the guide tracks 28 and 30 by placing respective guide members 32, in assembly with each of two opposed support brackets 190, respectively, in the guide tracks 28 and 30 and then sliding the respective brackets along and adjacent to the tracks into engagement with the end stiles 42 and 44 in the manner described above in conjunction with FIGS. 18 through 22. The lowermost panel 22 is now secured between the tracks 28 and 30. The lowermost panel 22 will also, at this time, be provided with spaced apart hinge members 144, for example, secured to the upper edge 38 in the manner previously described while the next panel 22 to be connected to the lowermost panel 22 is assembled to hinge members 142 at corresponding spacings on the lower edge 40 of the next panel 22.

The next panel 22 may then be placed in position by moving the next panel generally laterally into a position between the guide tracks 28 and 30, and just above the lowermost panel 22 and then moving the next panel downward between the guide tracks to snap the hinge members 142 into engagement with the respective hinge members 144 to form the hinge assemblies 140. While holding the next panel 22 in position between the guide tracks 28 and 30, and substantially coplanar with the lowermost panel 22, the brackets 190, in assembly with guide members 32 may be positioned above the upper edge 38 of the next panel 22 while placing the guide member rollers 32*a* in the track grooves 28*a* and 30*a* and then moving the brackets downward to be snapped into the slots formed by the tabs on the respective end stiles 42 and 44. Next panel 22 is now secured between the tracks 28 and 30 and is ready to receive a third panel 22 of the door 20 which is assembled to the door in the same manner just described.

Prior to assembly of a third panel to the door 20, brackets 190 may also be firmly secured to the upper edge 38 of the next or second panel by inserting the fasteners 116 in tight engagement with the web part 192*a* to secure each bracket 190 to the inclined surface 68 of a panel 22, for example. The above described process is repeated for the third and fourth panels as will be appreciated by those skilled in the art. Accordingly, assembly of the door 20 is easily accomplished with the improved hinge assemblies and guide member support brackets of the present invention as will be appreciated from the foregoing description read in conjunction with the drawings. In this way the door 20 may be more easily assembled and does not require lifting the door panels 22 overhead for placement between the horizontal run portions 28*b* and 30*b* of the door guide tracks 28 and 30.

Those skilled in the art will also recognize that the hinge assemblies 160 or 180 may be easily substituted for the hinge assemblies 140 without modifying the assembly process just described. Moreover, disassembly of the door 20 may be carried out by substantially reversing the procedure just described and which also offers several advantages as will be appreciated by those skilled in the art.

Figure 23:
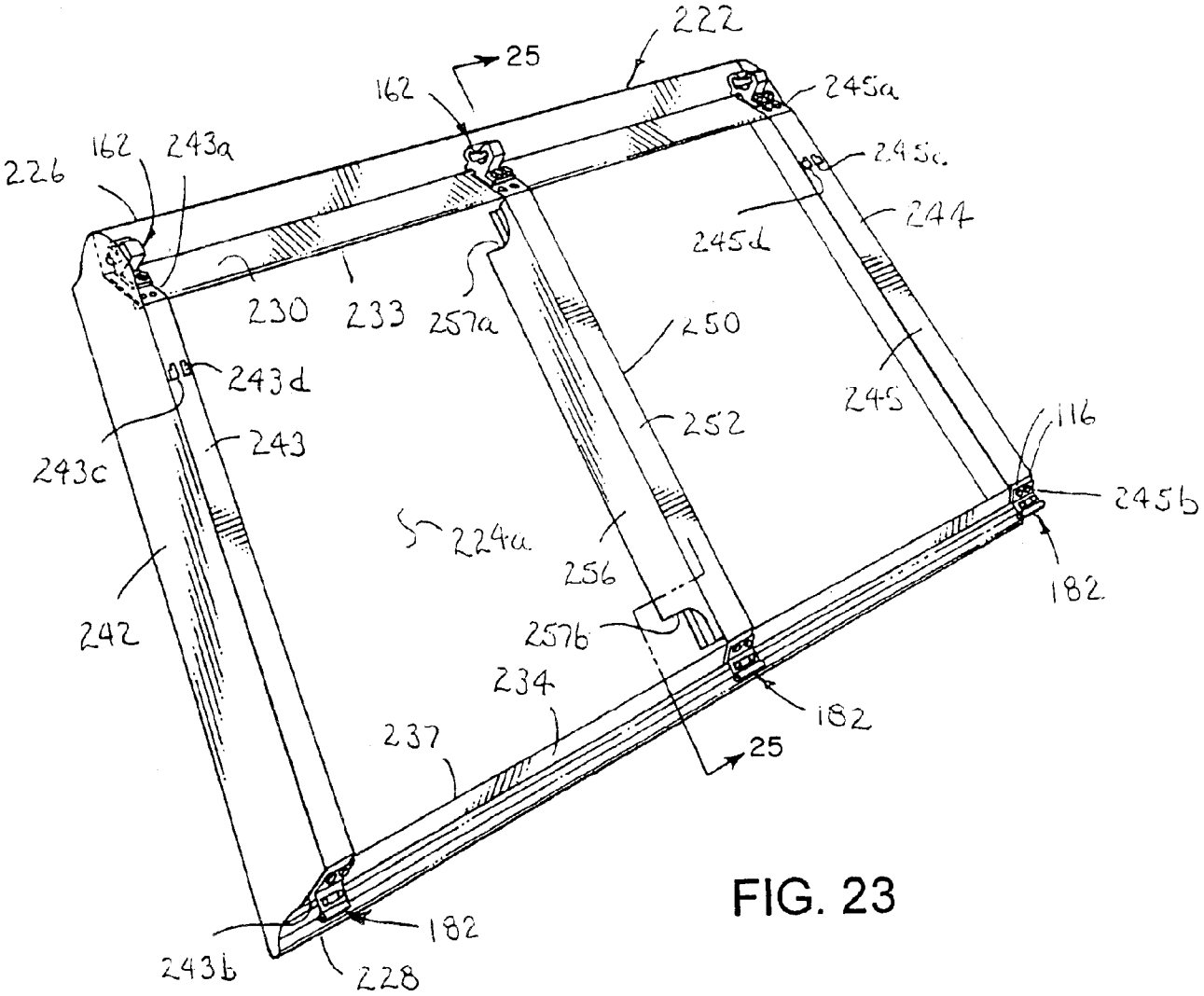
FIG. 23 is a perspective view of an uninsulated door panel in accordance with the present invention.
Figure 24:
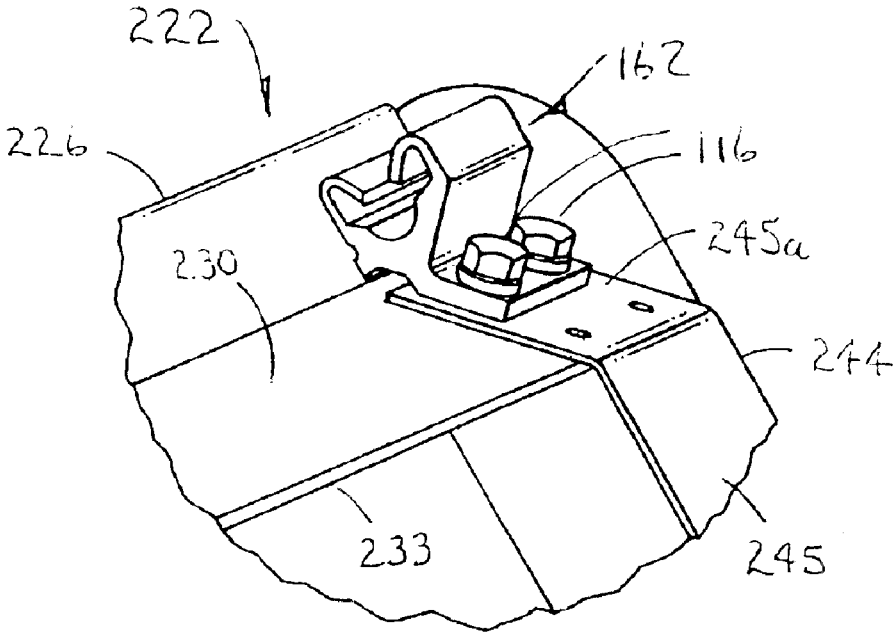
FIG. 24 is a detail view of a portion of the panel shown in FIG. 23 on a larger scale.
Figure 25:
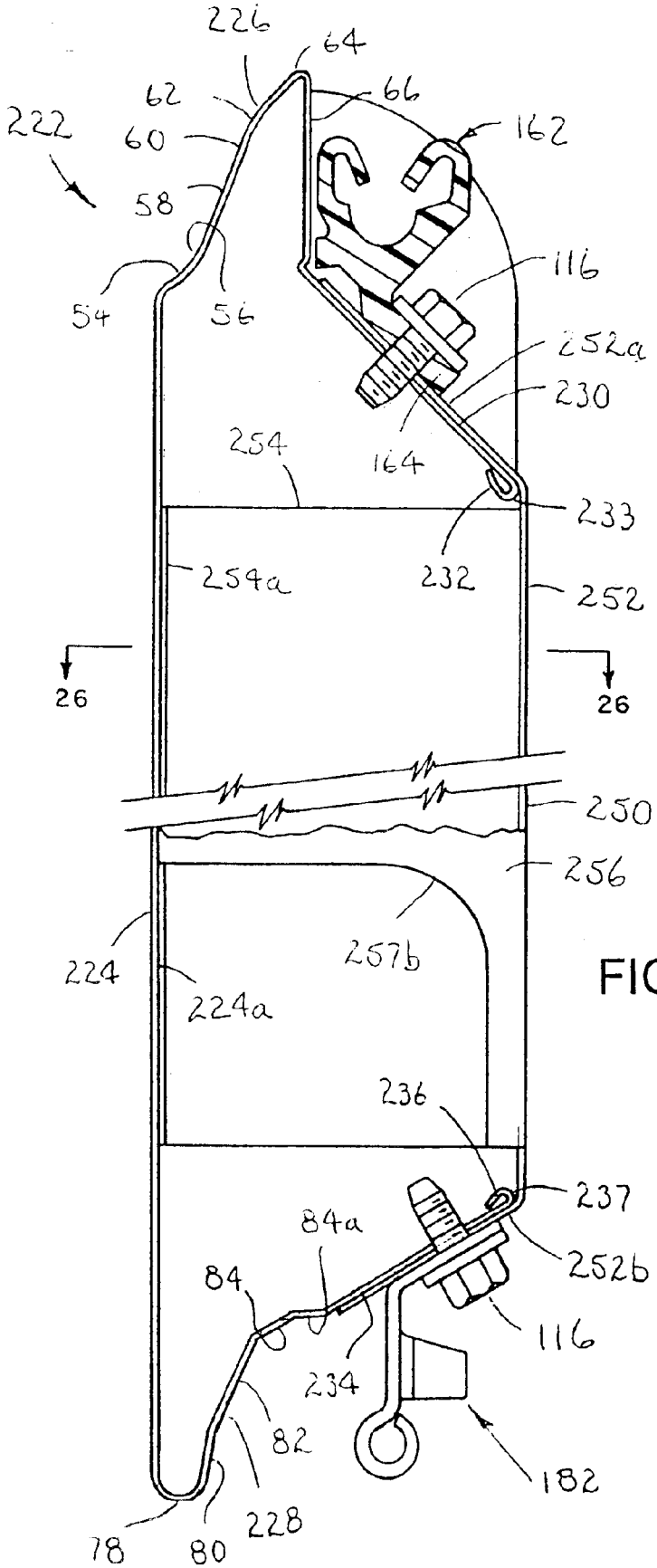
FIG. 25 is a section view taken generally along the line 25—25 of FIG. 23.

Referring now to FIGS. 23 through 25, a modified door panel 222 is illustrated and is characterized, generally, as a so-called pan type panel. Door panel 222 is used in applications where no insulating material is provided between the top and bottom edges of the panel such as is provided in the panels shown in FIGS. 5, 6 and 7 herein. Panel 222 includes a front, generally planar outer wall part or surface 224 extending between a top edge 226 and a bottom edge 228. The configurations of the top edges 226 and 228 are preferably substantially like the edges 38 and 40 of the panels 22. However, in one preferred embodiment of a pan type panel 222, the top edge terminates at a sloping or inclined surface 230 which may be folded back on itself at 232, FIG. 25, to reinforce a hem or distal edge 233, as illustrated. As further shown in FIG. 25, the bottom edge 228 terminates at an inclined inwardly extending surface 234 which is folded back on itself at 236 to define an inner distal edge 237 or hem substantially coplanar with the distal edge 233 in a plane generally parallel to surface 224. Moreover, in the configuration of the panel 222, the groove or recess 86 is replaced by an inclined surface 84*a* which is contiguous with planar surface 84 which, as with the panels 22, is contiguous with surface 82. As also shown in FIG. 25, the top edge 226 is configured to include surfaces 54, 58, 60, 62 and 64.

As shown in FIG. 23, the panel 222 is provided with reinforcing end stiles 242 and 244 which extend between the top and bottom edges 226 and 228 in generally the same manner that the end stiles 42 and 44 extend between the top and bottom edges of the panels 22. However, the end stiles 242 and 244 are provided with respective flanges 243 and 245 which have end portions which overlap and are disposed adjacent to the surfaces 230 and 234. As shown by way of example in FIG. 24, flange 245 of end stile 244 includes a partially folded portion 245*a* which extends over and is contiguous with the surface 230. Accordingly, the hinge part 162 is suitably secured to the panel 222, as shown in FIG. 24 by fasteners 116 which are adapted to extend through the flange portion 245*a* as well as the surface 230. The opposite end of flange 245 includes a partially folded portion 245*b*, FIG. 23, which overlies and is adjacent to the surface 234 and is adapted to receive the hinge part 182 suitably secured thereto and to the surface 234 by fasteners 116. As shown in FIG. 23, the end stile 242 is provided with similar flange portions 243*a* and 243*b* which overlap and are adjacent to the surfaces 230 and 234, respectively, and provide additional support for securing the hinge parts 162 and 182, for example, to the panel 222, as shown. The stiles 242 and 244 also include bracket receiving bosses 243*c*, 243*d*, 245*c* and 245*d*, respectively, corresponding to the bracket receiving bosses 43*a*, 43*b*, 45*a* and 45*b* of the stiles 42 and 44.

Figure 26:
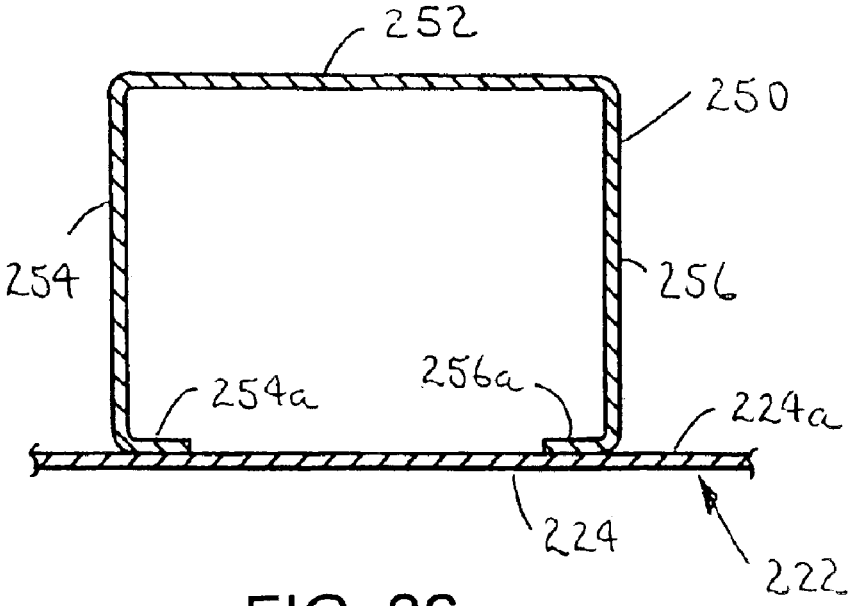
FIG. 26 is a detail section view taken generally along the line 26—26 of FIG. 25.

Referring further to FIG. 23, as well as FIGS. 25 and 26, one or more intermediate stiles 250, one shown, are adapted to be secured to the panel 222 to reinforce same and extending between the edges 226 and 228, as shown. Intermediate stile 250 is a somewhat channel shaped member with reentrant distal edges. For example, as shown in FIG. 26, intermediate stile 250 includes a web 252, opposed flanges 254 and 256 and reentrant flange edges 254*a* and 256*a* which are contiguous with the inner face 224*a* of outer skin or surface 224 of the panel 222 and may be secured thereto by a suitable adhesive or other fastening means known in the art.

As shown in FIG. 25, the web 252 includes opposed end parts 252*a* and 252*b* which are folded to overlap and be disposed adjacent to the inclined surfaces 230 and 234, respectively, to provide reinforcement for supporting the hinge parts 162 and 182, as shown. Accordingly, fasteners 116, which are preferably a self tapping threaded type, are secured to the panel 222 at reinforced areas of a panel provided by the surfaces 230 and 234 and by the stile web parts 252*a* and 252*b*, respectively. As shown in FIGS. 23 and 25, at least the flange 256 is relieved at recesses 257*a* and 257*b* to provide access for securing the stile 250 to the panel 222.

The construction, assembly, disassembly and use of the door 20 including the door panels 22 or 222 together with the hinge assemblies 23, 140, 160, 180 and the brackets 190 is believed to be within the purview of one of ordinary skill in the art based on the foregoing description. Materials used for fabricating the parts of the door panels and hinge assemblies of the invention may be conventional materials used for such elements. The hinge plates 162 and 162*a* may be advantageously molded of a suitable polymer material, such as polycarbonate or other high impact resistant plastic. However the hinge plates 162 and 162*a* may also be fabricated of materials such as glass filled polymers. Although preferred embodiments of a sectional door, door panels, hinge assemblies and other components particularly useful therewith have been described in detail hereinabove those skilled in the art will recognize that various substitutions and modifications may be made to the invention without departing from the scope and spirit of the appended claims.

What is claimed is:

1. A method for assembling a sectional upward acting door wherein said door is operable to be supported for movement between open and closed positions between a pair of opposed spaced apart guide tracks, said door including plural, generally planar panel members adapted to be connected to each other along opposed edges of adjacent panel members and said door including plural hinge assemblies including, respectively, opposed hinge plates adapted to be connected to upper and lower edges of adjacent panels, respectively, one of said hinge plates including a hinge pin and the other of said hinge plates including a pin receiving bore and an elastically deflectable retainer part for retaining said hinge pin in said pin receiving bore, said method comprising the steps of:

placing a first panel between said guide tracks;

placing a second panel between said guide tracks and adjacent to said first panel wherein an edge of said first panel is adjacent an edge of said second panel; and moving said panels toward each other in a direction substantially parallel to said guide tracks to connect said panels by registering said hinge pins in said pin receiving bores, respectively, by elastically deflecting said retainer parts, respectively, said retainer parts being elastically restored to positions to retain said hinge pins in said pin receiving bores, respectively.

2. The method set forth in claim 1 including the step of:

mounting support brackets on opposite side edges of said second panel with opposed guide members connected to said support brackets for supporting said second panel between said guide tracks.

3. The method set forth in claim 2 wherein:

the step of connecting said support brackets to said second panel comprises sliding said support brackets into engagement with said second panel at spaced apart bracket receiving tabs formed on structural members of said second panel, respectively.

4. The method set forth in claim 1 including the step of:

providing said other hinge plate to include a web part, spaced apart flanges secured to said web part and extending generally parallel to each other, and said retainer part comprising an elastically deflectable tab formed on each of said flanges, a pin receiving bore formed in each of said flanges and guide surfaces formed on each of said flanges for guiding opposed distal ends of said hinge pin into said pin receiving bores, respectively.

5. The method set forth in claim 1 including the step of:

providing said one hinge plate to include opposed parts engageable with said other hinge plate to prevent longitudinal displacement of said hinge plates relative to each other sufficient to disengage said hinge plates from each other in predetermined positions of said hinge plates with respect to each other.

6. The method set forth in claim 1 including the step of:

providing said hinge pin integrally formed on said one hinge plate.

7. A method for assembling a sectional upward acting door wherein said door is operable to be supported for movement between open and closed positions between a pair of opposed spaced apart guide tracks, said door including plural, generally planar panel members adapted to be connected to each other along opposed edges of adjacent panel members and said door including plural hinge assemblies including, respectively, opposed hinge plates connected to upper and lower edges of adjacent panels, respectively, one of said hinge plates including a hinge pin part and the other of said hinge plates including a pin receiving bore and an elastically deflectable pin retainer part adjacent to said pin receiving bore, said method comprising the steps of:

placing a first panel in a predetermined position;

placing a second panel adjacent to said first panel wherein an edge of said first panel is adjacent an edge of said second panel; and moving said panels toward each other to connect said panels by elastically deflecting said retainer parts with said pins, respectively, to register said pins in said pin receiving bores, respectively, and to retain said pins in said pin receiving bores with said retainer parts by elastically restoring said retainer parts pin retaining positions, respectively.

8. The method set forth in claim 7 including the step of:

mounting support brackets on opposite side edges of said second panel with opposed guide members connected to said support brackets for supporting said second panel between said guide tracks.

9. A method for assembling a sectional upward acting door wherein said door is operable to be supported for movement between open and closed positions between a pair of opposed spaced apart guide tracks, said door including plural, generally planar panel members adapted to be connected to each other along opposed edges of adjacent panel members and said door including plural hinge assemblies including, respectively, opposed hinge plates adapted to be connected to upper and lower edges of adjacent panels, respectively, one of said hinge plates including a hinge pin part and the other of said hinge plates including a pin receiving bore, said method comprising the steps of:

providing said other hinge plate to include at least one elastically deflectable finger defining in part a gap for receiving said hinge pin;

placing a first panel between said guide tracks;

placing a second panel between said guide tracks and adjacent to said first panel wherein an edge of said first panel is adjacent an edge of said second panel;

moving said panels toward each other to connect said panels by registering said hinge pins in said pin receiving bores, respectively; and deflecting said fingers to insert said hinge pins into said pin receiving bores, respectively, said fingers being elastically restorable to a position to retain said hinge pins in said pin receiving bores.

10. A method for assembling a sectional upward acting door wherein said door is operable to be supported for movement between open and closed positions between a pair of opposed spaced apart guide tracks, said door including plural, generally planar panel members adapted to be connected to each other along opposed edges of adjacent panel members and said door including plural hinge assemblies including, respectively, opposed hinge plates adapted to be connected to upper and lower edges of adjacent panels, respectively, one of said hinge plates including a hinge pin and the other of said hinge plates including a pin receiving bore and a retainer comprising an elastically deflectable tab formed on each of opposed flanges for retaining opposite ends of said hinge pin in said pin receiving bores, respectively, said method comprising the steps of:

placing a first panel between said guide tracks;

placing a second panel between said guide tracks and adjacent to said first panel wherein an edge of said first panel is adjacent an edge of said second panel;

moving one of said panels toward the other of said panels to connect said panels by registering said hinge pins in said pin receiving bores and retaining said hinge pins in said pin receiving bores in response to insertion of said hinge pins in said pin receiving bores, respectively; and mounting support brackets on opposite side edges of at least one of said panels with opposed guide members connected to said support brackets for supporting said one panel between said guide tracks.

11. A method for assembling a sectional upward acting door wherein said door is operable to be supported for movement between open and closed positions between a pair of opposed spaced apart guide tracks, said door including plural, generally planar panel members adapted to be connected to each other along opposed edges of adjacent panel members and said door including plural hinge assemblies including, respectively, opposed hinge plates adapted to be connected to upper and lower edges of adjacent panels, respectively, one of said hinge plates including a hinge pin and the other of said hinge plates including a pin receiving bore and a retainer comprising at least one elastically deflectable finger defining, in part, a gap for receiving said hinge pin, said at least one finger being elastically restorable to a position for retaining said hinge pin in said pin receiving bore, said method comprising the steps of:

placing a first panel between said guide tracks;

placing a second panel between said guide tracks and adjacent to said first panel wherein an edge of said first panel is adjacent an edge of said second panel;

moving one of said panels toward the other of said panels to connect said panels by deflecting said at least one finger of said hinge assemblies, respectively, to insert said hinge pins in said pin receiving bores and retaining said hinge pins in said pin receiving bores by said at least one finger, respectively, in response to insertion of said hinge pins in said pin receiving bores, respectively; and mounting support brackets on opposite side edges of at least one of said panels with opposed guide members connected to said support brackets for supporting said one panel between said guide tracks.

* * * * *